US006490857B2

(12) United States Patent
Sasaki

(10) Patent No.: US 6,490,857 B2
(45) Date of Patent: Dec. 10, 2002

(54) DEVICE FOR PURIFYING THE EXHAUST GAS OF AN INTERNAL COMBUSTION ENGINE

(75) Inventor: Shizuo Sasaki, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/891,403

(22) Filed: Jun. 27, 2001

(65) Prior Publication Data

US 2002/0002822 A1 Jan. 10, 2002

(30) Foreign Application Priority Data

Jun. 29, 2000 (JP) ..... 2000-201469

(51) Int. Cl.[7] ..... F02M 25/06
(52) U.S. Cl. ..... 60/278; 60/285; 60/297
(58) Field of Search ..... 60/274, 278, 285, 60/286, 295, 297, 311; 55/DIG. 30

(56) References Cited

U.S. PATENT DOCUMENTS

| | | | | | |
|---|---|---|---|---|---|
| 4,452,040 | A | * | 6/1984 | Kobashi | 60/286 |
| 4,515,758 | A | * | 5/1985 | Domesle et al. | 60/297 |
| 4,902,487 | A | | 2/1990 | Cooper et al. | |
| 5,100,632 | A | | 3/1992 | Dettling et al. | |
| 5,207,990 | A | * | 5/1993 | Sekiya et al. | 60/286 |
| 5,746,989 | A | * | 5/1998 | Murachi et al. | 60/274 |
| 5,826,425 | A | * | 10/1998 | Rossi Sebastiano et al. | 60/285 |
| 5,890,360 | A | * | 4/1999 | Sasaki et al. | 60/278 |
| 5,974,791 | A | * | 11/1999 | Hirota et al. | 60/286 |
| 6,167,696 | B1 | * | 1/2001 | Maaseidvaag et al. | 60/274 |
| 6,276,130 | B1 | * | 8/2001 | Ito et al. | 60/278 |
| 6,293,096 | B1 | * | 9/2001 | Khair et al. | 60/295 |
| 6,301,887 | B1 | * | 10/2001 | Gorel et al. | 55/DIG. 30 |
| 6,304,815 | B1 | * | 10/2001 | Moraal et al. | 60/295 |
| 6,338,245 | B1 | * | 1/2002 | Shimoda et al. | 60/285 |

FOREIGN PATENT DOCUMENTS

| | | |
|---|---|---|
| JP | A 6-159037 | 6/1994 |
| JP | A 6-272541 | 9/1994 |
| JP | A 7-259533 | 10/1995 |
| JP | A 7-106290 | 11/1995 |
| JP | A 8-338229 | 12/1996 |
| JP | A 9-94434 | 4/1997 |
| JP | A 11-300165 | 11/1999 |
| JP | B2 3012249 | 12/1999 |
| JP | 2000-328974 | * 11/2000 |

* cited by examiner

*Primary Examiner*—Thomas Denion
*Assistant Examiner*—Tu M. Nguyen
(74) *Attorney, Agent, or Firm*—Oliff & Berridge, PLC

(57) ABSTRACT

A device for purifying the exhaust gas of an internal combustion engine is disclosed. The device has a particulate filter, arranged in the exhaust system, on which the trapped particulates are oxidized. The engine can be operated in a first operating mode in which it is given priority to improve the fuel consumption rate thereof and a second operating mode in which it is given priority to regenerate the particulate filter to oxidize the trapped particulates. One of the first operating mode and the second operating mode is selected to operate the engine at need.

8 Claims, 27 Drawing Sheets

DEVICE FOR PURIFYING THE EXHAUST GAS OF AN INTERNAL COMBUSTION ENGINE

BACKGROUND OF THE INVENTION

1. Field of the Invention

The present invention relates to a device for purifying the exhaust gas of an internal combustion engine.

2. Description of the Related Art

The exhaust gas of an internal combustion engine and, particularly, of a diesel engine, contains particulates comprising carbon as a chief component. Particulates are harmful materials and thus it has been suggested that a particulate filter should be arranged in the exhaust system to trap particulates before they are emitted into the atmosphere. In such a particulate filter, the trapped particulates must be burned and removed to prevent resistance to the exhaust gas from increasing due to the blocked meshes.

In such a regeneration of the particulate filter, if the temperature of the particulates becomes about 600 degrees C., they ignite and burn. However, usually, the temperature of an exhaust gas of a diesel engine is considerably lower than 600 degrees C. and thus a heating means is required to heat the particulate filter itself.

Japanese Examined Patent Publication No. 7-106290 discloses that if one of the platinum group metals and one of the oxides of the alkali earth metals are carried on the filter, the particulates on the filter burn and are removed successively at about 400 degrees C. 400 degrees C. is a typical temperature of the exhaust gas of a diesel engine.

However, when the above-mentioned filter is used, the temperature of the exhaust gas is not always about 400 degrees C. Further, a large amount of particulates can be discharged from the engine. Thus, particulates that cannot be burned and removed each time can deposit on the filter.

In this filter, if a certain amount of particulates deposits on the filter, the ability to burn and remove particulates drops so much that the filter cannot be regenerated by itself. Thus, if such a filter is merely arranged in the exhaust system, the blocking of the filter meshes can occur relative quickly.

On the other hand, when $NO_2$ reacts with the particulates on the particulate filter, the particulates can be burned at a relative low temperature ($NO_2+C \rightarrow NO+CO$, $NO_2+CO \rightarrow NO+CO_2$, $2NO_2+C \rightarrow 2NO+CO_2$). However, most of $NO_x$ included in the exhaust gas is NO and thus NO must be converted to $NO_2$ to make the particulates burn using $NO_2$. Japanese Unexamined Patent Publication No. 8-338229 discloses an oxidation catalytic apparatus arranged upstream particulate filter. The oxidation catalytic apparatus can convert NO to $NO_2$. Further a known $NO_x$ absorbent can release the absorbed NO as $NO_2$. Japanese Unexamined Patent Publication No. 8-338229 also discloses that the $NO_x$ absorbent is carried on the particulate filter. Thus, $NO_2$ converted by the oxidation catalytic apparatus and $NO_2$ released by the $NO_x$ absorbent can burn the particulates on the particulate filter at a relative low temperature. However, in low-engine-load operations, the temperature of the exhaust gas becomes very low, the oxidation catalytic apparatus cannot convert NO to $NO_2$ and the $NO_x$ absorbent cannot release $NO_2$. Accordingly, Japanese Unexamined Patent Publication No. 8-338229 discloses that in the low engine load operating area, fuel and secondary air are always supplied into the exhaust system to raise the temperature of the particulate filter by the burned heat thereof. Thus, in Japanese Unexamined Patent Publication No. 8-338229, the fuel consumption rate of the engine deteriorates.

SUMMARY OF THE INVENTION

Therefore, an object of the present invention is to provide a device, for purifying the exhaust gas of an internal combustion engine, which can prevent blocking of the particulate filter meshes by the trapped particulates thereon without deterioration of the fuel consumption rate of the engine.

According to the present invention, there is provided a device for purifying the exhaust gas of an internal combustion engine comprising a particulate filter arranged in the exhaust system, on which the trapped particulates are oxidized, wherein the engine can be operated in a first operating mode in which it is given priority to improve the fuel consumption rate thereof and a second operating mode in which it is given priority to regenerate the particulate filter to oxidize the trapped particulates, and one of the first operating mode and the second operating mode is selected to operate the engine at need.

BRIEF DESCRIPTION OF THE DRAWINGS

In the drawings:

FIG. 15 is a view showing the amounts of produced smoke, $NO_x$, and the like;

DESCRIPTION OF THE PREFERRED EMBODIMENT

By referring the attached drawings, embodiments of the present invention are explained as follows.

Figure 1:
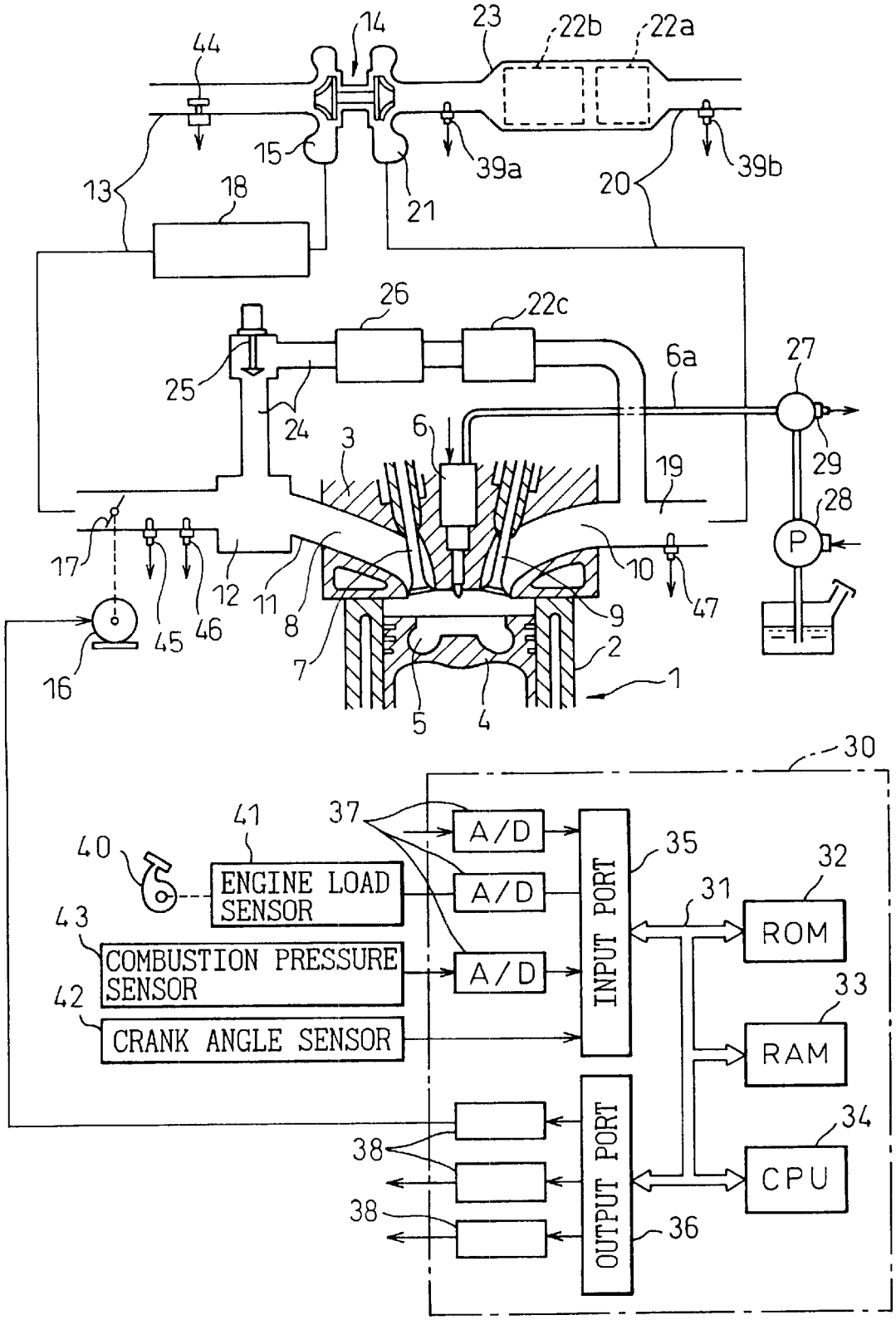
FIG. 1 is a schematic vertical sectional view of a diesel engine with a device for purifying the exhaust gas according to the present invention.

FIG. 1 is a schematic vertical sectional view of a four-stroke diesel engine with a device for purifying the exhaust gas according to the present invention. The device for purifying the exhaust gas according to the present invention can also be applied to a spark ignition engine. Referring to FIG. 1, reference numeral 1 designates an engine body, reference numeral 2 designates a cylinder-block, reference numeral 3 designates a cylinder-head, reference numeral 4 designates a piston, reference numeral 5 designates a combustion chamber, reference numeral 6 designates an electrically controlled fuel injector, reference numeral 7 designates a pair of intake valves, reference numeral 8 designates an intake port, reference numeral 9 designates a pair of exhaust valves, and reference numeral 10 designates an exhaust port. The intake port 8 is connected to a surge tank 12 via a corresponding intake tube 11. The surge tank 12 is connected to a compressor 15 of a turbocharger 14 via an intake duct 13. A throttle valve 17 driven by a step motor 16 is arranged in the intake duct 13. An intake air cooler 18 is arranged around the intake duct 13 to cool intake air flowing therein. In the embodiment shown in FIG. 1, the engine cooling water is led into the intake air cooler 18 and the engine cooling water cools the intake air. Further, in the intake duct 13, an air-flow meter 44 for detecting an amount of intake air, a negative pressure sensor 45 for detecting a negative pressure therein, and an intake air temperature sensor 46 for detecting an intake air temperature are arranged.

On the other hand, the exhaust port 10 is connected to a turbine 21 of the turbocharger 14 via an exhaust manifold 19 and an exhaust duct 20. The outlet of the turbine 21 is connected to a casing 23 including a particulate filter 22*a* and a catalytic apparatus 22*b* for absorbing and reducing $NO_x$. The catalytic apparatus 22*b* is arranged in the exhaust gas upstream side of the particulate filter 22*a*. In a modification of the present embodiment, another oxidation catalytic apparatus having an oxidation function is arranged instead of the catalytic apparatus 22*b* for absorbing and reducing $NO_x$. Further, in another modification of the present embodiment, the catalytic apparatus 22*b* is not adjacent to the particulate filter 22*a* and the catalytic apparatus 22*b* is arranged apart from the particulate filter 22*a*. An air-fuel ratio sensor 47 is arranged in the exhaust manifold 19. A flowing-in gas temperature sensor 39*a* is arranged in the exhaust duct 20 upstream of the casing 23 to detect a temperature of the exhaust gas flowing in the casing 23, i.e., a flowing-in gas temperature. A flowing-out gas temperature sensor 39*b* is arranged in the exhaust duct 20 downstream the casing 23 to detect a temperature of the exhaust gas flowing out from the casing 23, i.e., a flowing-out gas temperature.

The exhaust manifold 19 and the surge tank 12 are connected with each other via an exhaust gas recirculation (EGR) passage 24. An electrically controlled EGR control valve 25 is arranged in the EGR passage 24. An EGR cooler 26 is arranged around the EGR passage 24 to cool the EGR gas flowing therein. In the embodiment of FIG. 1, the engine cooling water is led into the EGR cooler 26 and the engine cooling water cools the EGR gas. Further, a pipe catalytic apparatus 22*c* is arranged at the EGR gas upstream side of the EGR cooler 26 in the EGR passage 24 to purify the EGR gas. On the other hand, each fuel injector 6 is connected to the fuel reservoir, that is, a common rail 27 via a fuel supply tube 6*a*. Fuel is supplied in the common rail 27 from an electrically controlled variable discharge fuel pump 28. Fuel supplied in the common rail 27 is supplied to the fuel injector 6 via each fuel supply tube 6*a*. A fuel pressure sensor 29 for detecting a fuel pressure in the common rail 27 is attached to the common rail 27. The discharge amount of the fuel pump 28 is controlled on the basis of an output signal of the fuel pressure sensor 29 such that the fuel pressure in the common rail 27 becomes the target fuel pressure.

Reference numeral 30 designates an electronic control unit. It is comprised of a digital computer and is provided with a ROM (read only memory) 32, a RAM (random access memory) 33, a CPU (microprocessor) 34, an input port 35, and an output port 36 connected with each other by a bi-directional bus 31. The output signal of the fuel pressure sensor 29 is input to the input port 35 via a corresponding A/D converter 37. The output signals of the flowing-in gas temperature sensor 39*a* and the flowing-out gas temperature sensor 39*b* are input to the input port 35 via a corresponding A/D converter 37 respectively. The output signal of the air-flow meter 44 is input to the input port 35 via a corresponding A/D converter 37. The output signal of the negative pressure sensor 45 is input to the input port 35 via a corresponding A/D converter 37. The output signal of the intake air temperature sensor 46 is input to the input port 35 via a corresponding A/D converter 37. An engine load sensor 41 is connected to the accelerator pedal 40, which generates an output voltage proportional to the amount of depression (L) of the accelerator pedal 40. The output signal of the engine load sensor 41 is also input to the input port 35 via a corresponding A/D converter 37. The output signal of a combustion pressure sensor 43 for detecting a combustion pressure in the cylinder is input to the input port 35 via a corresponding A/D converter 37. Further, the output signal of a crank angle sensor 42 for generating an output pulse each time the crankshaft rotates by, for example, 30 degrees is also input to he input port 35. On the other hand, the output port is connected to the fuel injector 6, the step motor 16 for the throttle valve, the EGR control valve 25, and the fuel pump 28 are connected to the output port 36 via each drive circuit 38.

Figure 2A:
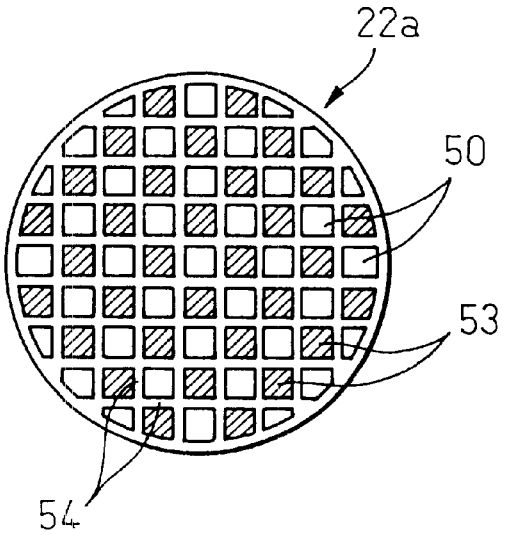
FIG. 2(A) is a front view showing the structure of the particulate filter.
Figure 2B:
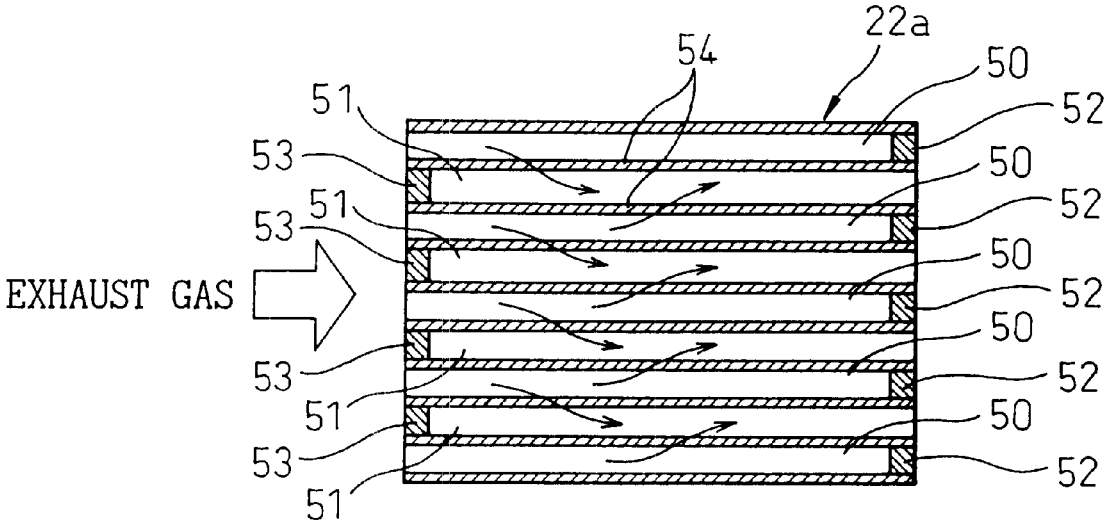
FIG. 2(B) is a side sectional view showing the structure of the particulate filter.

FIG. 2 shows the structure of the particulate filter 22*a*, wherein FIG. 2(A) is a front view of the particulate filter 22*a* and FIG. 2(B) is a side sectional view thereof. As shown in these figures, the particulate filter 22*a* is the wall-flow type of a honeycomb structure formed of a porous material such as cordierite, and has many spaces in the axial direction divided by many partition walls 54 extending in the axial direction. One of any to neighboring spaces is closed by a plug 52 on the exhaust gas downstream side, and the other one is closed by a plug 53 on the exhaust gas upstream side. Thus, one of the two neighboring spaces serves as an exhaust gas flowing-in passage 50 and the other one serves as an exhaust gas flowing-out passage 51, causing the exhaust gas to necessarily pass through the partition wall 54 as indicated by arrows in FIG. 2(B).

In the present embodiment, a carrying layer consisting of, for example, an alumina is formed on both side surfaces of the each partition wall 54, the pores surfaces therein, the external end surface of the plug 53, and the internal end surfaces of the plugs 52, 53. The carrying layer carries an oxygen absorbing and active-oxygen releasing agent ad a noble metal catalyst. In the present embodiment, platinum Pt is used as the noble metal catalyst. The oxygen absorbing and active-oxygen releasing agent releases active-oxygen to promote the oxidation of the particulates and, preferably, takes in and holds oxygen when excessive oxygen is present in the surroundings and releases the held oxygen as active-oxygen when the oxygen concentration in the surroundings drops. As the oxygen absorbing and active-oxygen releasing agent, there is used at least one selected from alkali metals such as potassium K, sodium Na, Lithium Li, cesium Cs, and rubidium Rb, alkali earth metals such as barium Ba, calcium Ca, and strontium Br, rare earth elements such as lanthanum La and yttrium Y, and transition metals. As an oxygen absorbing and active-oxygen releasing agent, it is desired to use an alkali metal or an alkali earth metal having an ionization tendency stronger than that of calcium Ca, i.e., to use potassium K, Lithium Li, cesium Cs, rubidium Rb, barium Ba, or strontium Sr.

Next, explained below is how the trapped particulates on the particulate filter 22*a* are oxidized and removed with reference to the case of using platinum Pt and potassium K. The particulates are oxidized and removed in the same manner even when using another noble metal and another alkali metal, an alkali earth metal, a rare earth element, or a transition metal. In a diesel engine as shown in FIG. 1, the combustion usually takes place in an excess air condition and, hence, the exhaust gas contains a large amount of excess air. That is, if the ratio of the air to the fuel supplied to the intake system and to the combustion chamber is referred to as an air-fuel ratio of the exhaust gas, the air-fuel ratio is lean. Further, NO is generated in the combustion chamber and, hence, the exhaust gas contains NO. Further, the fuel contains sulfur S and sulfur S reacts with oxygen in the combustion chamber to form $SO_2$. Accordingly, the exhaust gas containing excessive oxygen, NO, and $SO_2$ flows into the exhaust gas flowing-in passage 50 of the particulate filter 22*a*.

Figure 3A:
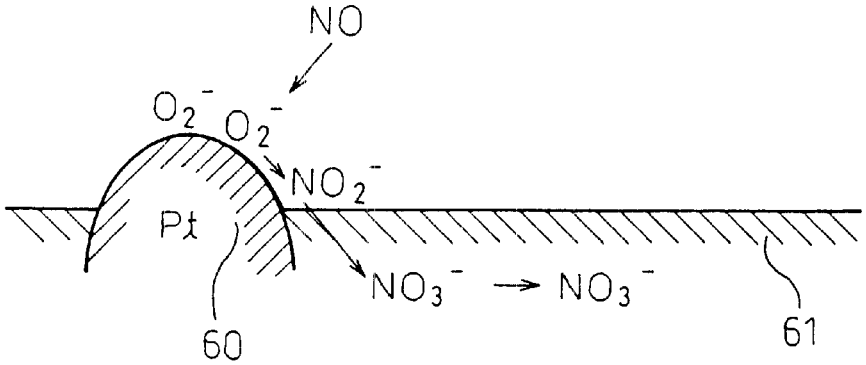
FIGS. 3(A) and 3(B) are enlarged views of the carrying layer of the particulate filter.
Figure 3B:
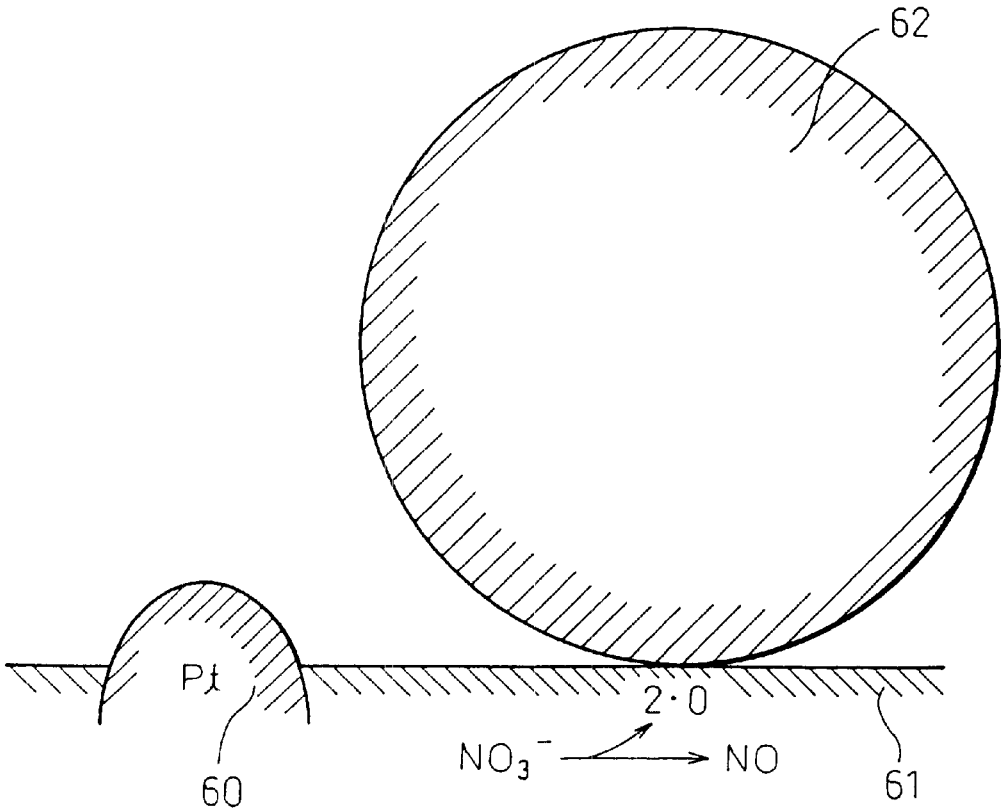

FIGS. 3(A) and 3(B) are enlarged views schematically illustrating the surface of the carrying layer formed on the inside surface of the exhaust gas flowing-in passage 50. In FIGS. 3(A) and 3(B), reference numeral 60 denotes a particle of platinum Pt and 61 denotes the oxygen absorbing and active-oxygen releasing agent containing potassium K. As described above, the exhaust gas contains a large amount of excess oxygen. When the exhaust gas flows in the exhaust gas flowing-in passage 50, oxygen $O_2$ adheres onto the surface of platinum Pt in the form of $O_2^-$ or $O^{2-}$ as shown in FIG. 3(A). On the other hand, NO in the exhaust gas reacts with $O_2^-$ or $O^{2-}$ on the surface of platinum Pt to produce $NO_2$ ($2NO+O_2 \rightarrow 2NO_2$). Next, a part of the produced $NO_2$ is absorbed in the oxygen absorbing and active-oxygen releasing agent 61 while being oxidized on platinum Pt, and diffuses in the oxygen absorbing and active-oxygen releasing agent 61 in the form of nitric acid ions $NO_3^-$ while being combined with potassium K to form potassium nitrate $KNO_3$ as shown in FIG. 3(A).

Further, the exhaust gas contains $SO_2$, as described above, and $SO_2$ also is absorbed in the oxygen absorbing and active-oxygen releasing agent 61 due to a mechanism similar to that of the case of NO. That is, as described above, oxygen $O_2$ adheres on the surface of platinum Pt in the form of $O_2^-$ or $O^{2-}$, and $SO_2$ in the exhaust gas reacts with $O_2^-$ or $O^{2-}$ on the surface of platinum Pt to produce $SO_3$. Next, a part of the produced $SO_3$ is absorbed in the oxygen absorbing and active-oxygen releasing agent 61 while being oxidized on the platinum Pt and diffuses in the oxygen absorbing and active-oxygen releasing agent 61 in the form of sulfuric acid ion $SO_4^{2-}$ while being combined with potassium K to produce potassium sulfate $K_2SO_4$. Thus, potassium nitrate $KNO_2$ and potassium sulfate $K_2SO_4$ are produced in the oxygen absorbing and active-oxygen releasing agent 61.

On the other hand, particulates comprising carbon as a chief component are produced in the combustion chamber. Therefore, these particulates are contained in the exhaust gas. When the exhaust gas flows along the exhaust gas flowing-in passage 50 of the particulate filter 22*a*, and when the exhaust gas passes through the partition wall 51 of the particulate filter 22*a*, the particulates in the exhaust gas adhere on surface of the carrying layer, for example, the surface of the oxygen absorbing and active-oxygen releasing agent 61 as designated at 62 in FIG. 3(B).

At this time, the oxygen concentration drops on the surface of the oxygen absorbing and active-oxygen releasing agent 61 with which the particulate 62 is in contact. As the oxygen concentration drops, there occurs a difference in the concentration at the oxygen absorbing and active-oxygen releasing agent 61 having a high oxygen concentration and, thus, oxygen in the oxygen absorbing and active-oxygen releasing agent 61 tends to migrate toward the surface of the oxygen absorbing and active-oxygen releasing agent 61 with which the particulate 62 is in contact. As a result, potassium nitrate $KNO_3$, produced in the oxygen absorbing and active-oxygen releasing agent 61, is decomposed into potassium K, oxygen O and NO, whereby oxygen O migrates toward the oxygen absorbing and surface of the active-oxygen releasing agent 61 with which the particulate 62 is in contact, and NO is emitted to the external side from the oxygen absorbing and active-oxygen releasing agent 61. NO emitted to the outside is oxidized on platinum Pt on the downstream side and is absorbed again in the oxygen absorbing and active-oxygen releasing agent 61.

At this time, further, potassium sulfate $K_2SO_4$ produced in the oxygen absorbing and active-oxygen releasing agent 61 is also decomposed into potassium K, oxygen O, and $SO_2$, whereby oxygen O migrates toward the surface of the oxygen absorbing and active-oxygen releasing agent 61 with which the particulate 62 is in contact, and $SO_2$ is emitted to the outside from the oxygen absorbing and active-oxygen releasing agent 61. $SO_2$ released to the outside is oxidized on platinum Pt on the downstream side and is absorbed again in the oxygen absorbing and active-oxygen releasing agent 61. Here, however, potassium sulfate $K_2SO_4$ is stable and releases less active-oxygen than potassium nitrate $KNO_3$. Therefore, when the temperature of the particulate filter is low, even if oxygen concentration in the surroundings drops, a large amount of active-oxygen is not released.

On the other hand, oxygen O migrating toward the surface of the oxygen absorbing and active-oxygen releasing agent 61 with which the particulate 62 is in contact is decomposed from such compounds as potassium nitrate $KNO_3$ or potassium sulfate $K_2SO_4$. Oxygen O decomposed from the compound has a high level of energy and exhibits a very high activity. Therefore, oxygen migrating toward the surface of the oxygen absorbing and active-oxygen releasing agent 61, with which the particulate 62 is in contact, is active-oxygen O. Upon coming into contact with active-oxygen O, the particulate 62 is oxidized, without producing luminous flame, in a short time, for example, a few minutes or a few tens of minutes. Further, active-oxygen to oxidize the particulate 62 is also released when NO and $SO_2$ are absorbed in the active-oxygen releasing agent 61. That is, it can be considered that $NO_x$ diffuses in the oxygen absorbing and active-oxygen releasing agent 61 in the form of nitric acid ions $NO_3^-$ while being combined with an oxygen atom to be separated from an oxygen atom, and during this time, active-oxygen is produced. The particulates 62 are also oxidized by this active-oxygen. Further, the particulates adhered on the particulate filter 22*a* are not oxidized only by active-oxygen, but also by oxygen contained in the exhaust gas.

Usually, when the particulates deposited on the particulate filter burn, the particulates filter becomes red-hot and luminous flame is produced. Such a burning requires a high temperature. To continue the burning, the particulate filter must be kept at a high temperature.

In the present invention, the particulates 62 are oxidized without producing luminous flame and the particulate filter does not become red-hot. That is, in the present invention, the particulates are oxidized at a low temperature. Thus, the oxidization of the particulates according to the present invention is different from the usual burning of the particulates.

The higher the temperature of the particulate filter becomes, the more the platinum Pt and the oxygen absorbing and active-oxygen releasing agent 61 are activated. Therefore, the higher the temperature of the particulate filter 22*a* becomes, the larger the amount of active-oxygen O released from the oxygen absorbing and active-oxygen releasing agent 61 per unit time becomes. Further, naturally, the higher the temperature of particulates is, the more easily the particulates are oxidized. Therefore, the amount of particulates that can be oxidized and removed without producing luminous flame on the particulate filter 22*a* per unit time increases along with an increase in the temperature of the particulate filter 22*a*.

Figure 5:
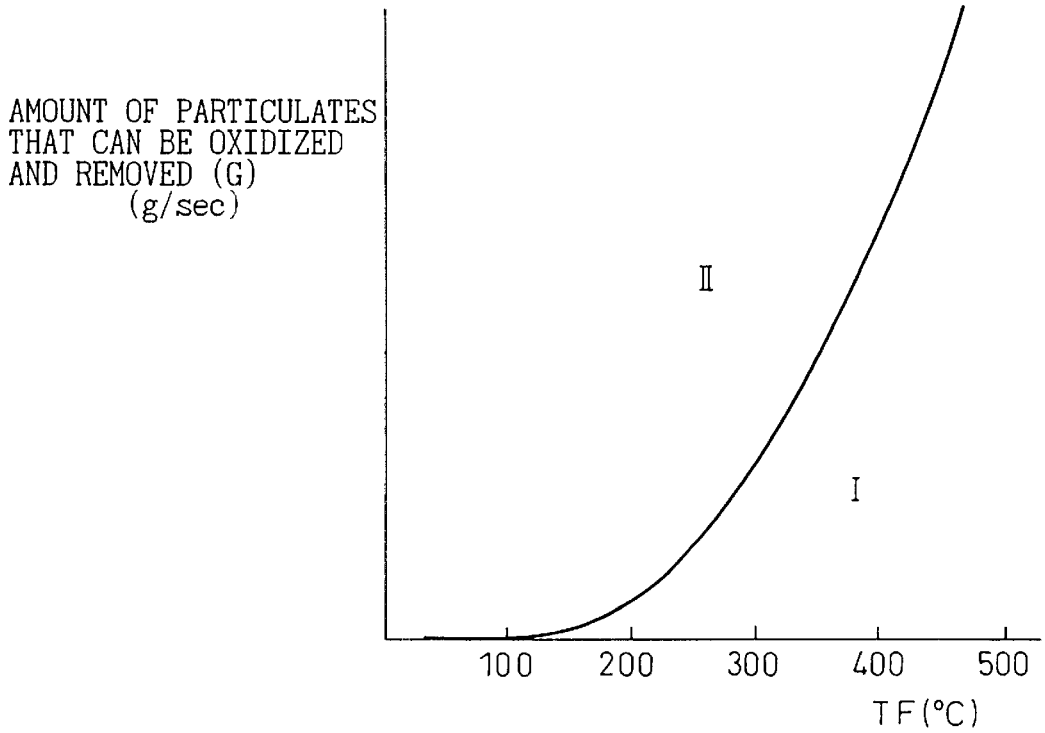
FIG. 5 is a view showing the amount of particulates that can be oxidized and removed without producing luminous flame per unit time.

The solid line in FIG. 5 shows the amount of particulates (G) that can be oxidized and removed without producing luminous flame per unit time. In FIG. 5, the abscissa represents the temperature (TF) of the particulate filter 22*a*. Here, FIG. 5 shows the case that the unit time is 1 second, that is, the amount of particulates (G) that can be oxidized and removed per 1 second. However, any time such as 1 minute, 10 minutes, or the like can be selected as unit time. For example, in the case that 10 minutes is used as unit time, the amount of particulates (G) that can be oxidized and removed per unit time represents the amount of particulates (G) that can be oxidized and removed per 10 minutes. In also this case, the amount of particulates (G) that can be oxidized and removed without producing luminous flame increases along with an increase in the temperature of particulate filter 22*a* as shown in FIG. 5.

The amount of particulates emitted from the combustion chamber per unit time is referred to as an amount of emitted particulates (M). When the amount of emitted particulates (M) is smaller than the amount of particulates (G) that can be oxidized and removed, for example, the amount of emitted particulates (M) per 1 second is smaller than the amount of particulates (G) that can be oxidized and removed per 1 second or the amount of emitted particulates (M) per 10 minutes is smaller than the amount of particulates (G) that can be oxidized and removed per 10 minutes, that is, in the area (I) of FIG. 5, the particulates emitted from the combustion chamber are all oxidized and removed without producing luminous flame successively on the particulate filter 22*a* for the above mentioned short time.

Figure 4A:
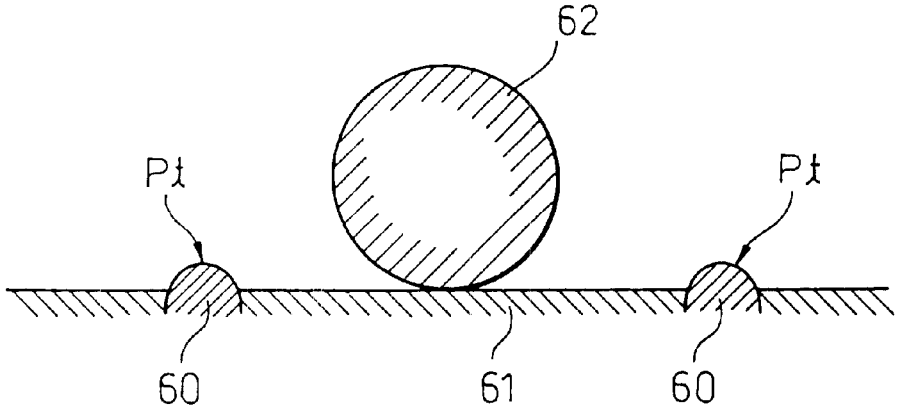
FIGS. 4(A), 4(B), and 4(C) are views showing the oxidation phase of the particulates.
Figure 4B:
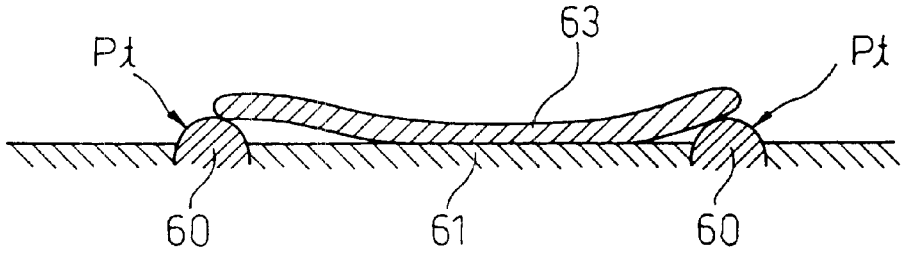
Figure 4C:
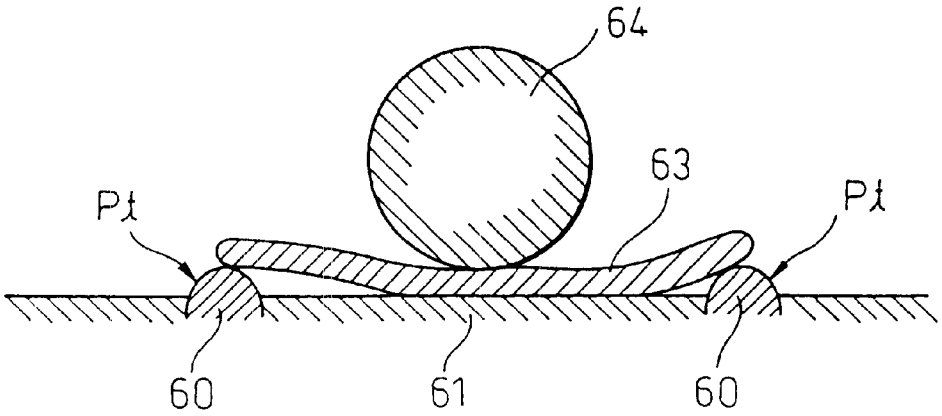

On the other hand, when the amount of emitted particulates (M) is larger than the amount of particulates that can be oxidized and removed (G), that is, in the area (II) of FIG. 5, the amount of active-oxygen is not sufficient for all particulates to be oxidized and removed successively. FIGS. 4(A) to (C) illustrate the manner of oxidation of the particulates in such as case.

That is, in the case that the amount of active-oxygen is lacking for oxidizing all particulates, when the particulates 62 adhere on the oxygen absorbing and active-oxygen releasing agent 61, only a part of the particulates is oxidized as shown in FIG. 4(A), and the other part of the particulates that was not oxidized sufficiently remains on the carrying layer of the particulate filter. When the state where the amount of active-oxygen is lacking continues, a part of the particulates that was not oxidized remains on the carrying layer of the particulate filter successively. As a result, the surface of the carrying layer of the particulate filter is covered with the residual particulates 63 as shown in FIG. 4(B).

The residual particulates 63 are gradually transformed into carbonaceous matter that can hardly be oxidized. Further, when the surface of the carrying layer is covered with the residual particulates 63, the action of platinum Pt for oxidizing NO and $SO_2$, and the action of the oxygen absorbing and active-oxygen releasing agent 61 for releasing active-oxygen are suppressed. Thus, as shown in FIG. 4(C), other particulates 64 deposit on the residual particulates 63 one after the other, and when the particulates are deposited so as to laminate, even if they are the easily oxidized particulates, these particulates may not be oxidized since these particulates are separated away from platinum Pt or from the oxygen absorbing and active-oxygen releasing agent. Accordingly, other particulates deposit successively on these particulates 64. That is, when the state where the amount of emitted particulates (M) is larger than the amount of particulates that can be oxidized and removed (G) continues, the particulates deposit to laminate on the particulate filter. Therefore, so far as the temperature of the exhaust gas is made high or the temperature of the particulate filter is made high, the deposited particulates cannot be removed.

Thus, in the area (I) of FIG. 5, the particulates are oxidized and removed without producing luminous flame for the short time and in the area (II) of FIG. 5, the particulates are deposited to laminate on the particulate filter. Therefore, the deposition of the particulates on the particulate filter can be prevented if the relationship between the amount of emitted particulates (M) and the amount of particulates that can be oxidized and removed (G) is in the area (I), i.e., the amount of emitted particulates (M) is made smaller than the amount of particulates that can be oxidized and removed (G).

As known from FIG. 5, in the particulate filter 22*a* of the present embodiment, when the temperature (TF) of the particulate filter 22*a* is very low, the particulates can be oxidized. Accordingly, in the diesel engine shown in FIG. 1, the amount of emitted particulates (M) and the temperature (TF) of the particulate filter 22*a* can be maintained such that the amount of emitted particulates (M) is always smaller than the amount of particulates that can be oxidized and removed. If the amount of emitted particulates (M) is always smaller than the amount of particulates that can be oxidized and removed (G), the particulates on the particulate filter 22*a* are favorably oxidized and removed so that a pressure loss, in the exhaust gas, in the particulate filter hardly changes and is maintained at a minimum pressure loss value that is nearly constant. Thus, the decrease of the engine output can be kept as low as possible. To make the amount of particulates that can be oxidized and removed (G) always larger than the amount of emitted particulates (M), if the amount of injected fuel is always increased so that the temperature of the exhaust gas is made high and thus the temperature (TF) of the particulate filter 22*a* is made high, the fuel consumption rate of the engine is deteriorated.

As above mentioned, when the particulates are deposited on the particulate filter 22*a* so as to laminate, even if the amount of emitted particulates (M) is made smaller than the amount of particulates that can be oxidized and removed (G), it is difficult for the deposited particulates to be oxidized by active-oxygen. However, when a part of the particulates that was not oxidized sufficiently remains on the particulate filter, i.e., when the amount of residual particulates is smaller than a given amount, if the amount of emitted particulate (M) becomes smaller than the amount of particulates that can be oxidized and removed (G), the residual particulates can be oxidized and removed by active-oxygen without producing luminous flame. Accordingly, the amount of emitted particulates (M) may be made smaller than the amount of particulates that can be oxidized and removed (G) at need. Namely, the amount of emitted particulates (M) may become temporarily larger than the amount of particulates that can be oxidized and removed (G) such that the surface of the carrying layer is not covered with the residual particulates, i.e., the state shown in FIG. 4(B) is not realized, i.e., such that the amount of residual particulates is smaller than the predetermined amount of which the residual particulates can be oxidized by active-oxygen when the amount of emitted particulates (M) becomes smaller than the amount of particulates that can be oxidized and removed (G). Thus, the amount of emitted particulates (M) and the temperature (TF) of the particulate filter 22*a* can be controlled such that the fuel consumption rate of the engine is improved. Immediately after the engine starting, the temperature (TF) of the particulate filter 22*a* is low. Accordingly, at this time, the amount of emitted particulates (M) becomes larger than the amount of particulates that can be oxidized and removed (G). However at this time, the amount of particulates that can be oxidized and removed (G) may not be compulsorily made larger than the amount of emitted particulates (M).

When the particulates deposit on the particulate filter so as to laminate, the air-fuel ratio is made rich and the temperature of the exhaust gas is made high by the fuel combustion in the exhaust stroke. Thus, the temperature (TF) of the particulate filter 22*a* rises and the state of the particulate filter 22*a* can be made in the area (I) of FIG. 5. Therefore, the particulates deposited on the particulate filter 22*a* can be oxidized without producing luminous flame. In this case, if oxygen concentration in the exhaust gas drops, active-oxygen O is released at once time from the oxygen absorbing and active-oxygen releasing agent 61 to the outside. Therefore, the deposited particulates become these that are easily oxidized by the large amount of active-oxygen released at one time, and can be oxidized and removed thereby without a luminous flame.

On the other hand, when the air-fuel ratio in the exhaust gas is maintained lean, the surface of platinum Pt is covered with oxygen, that is, oxygen contamination is caused. When such oxygen contamination is caused, the oxidization action, an $NO_x$, of platinum Pt drops and thus the absorbing efficiency of $NO_x$ drops. Therefore, the amount of active-oxygen released from the oxygen absorbing and active-oxygen releasing agent 61 decreases. However, when the air-fuel ratio is made rich, oxygen on the surface of Platinum Pt is consumed and thus the oxygen contamination is cancelled. Accordingly, when the air-fuel ratio is changed over from rich to lean again, the oxidization action to $NO_x$ becomes strong and thus the absorbing efficiency rises. Therefore, the amount of active-oxygen released from the oxygen absorbing and active-oxygen releasing agent 61 increases.

Thus, when the air-fuel ratio is maintained lean, if the air-fuel ratio is changed over from lean to rich once in a while, the oxygen contamination of platinum Pt is cancelled every time and thus the amount of released active-oxygen increases when the air-fuel ratio is lean. Therefore, the oxidization action of the particulates on the particulate filter 22*a* can be promoted.

Further, the cancellation of the oxygen contamination causes the reducing agent to burn and thus the burned heat thereof raises the temperature of the particulate filter. Therefore, in the particulate filter, the amount of particulates that can be oxidized and removed increases and thus the deposited particulates are oxidized and removed more easily.

When it is determined that the particulates deposit on the particulate filter 22*a* so as to laminate, the air-fuel ratio in the exhaust gas may be made rich. The air-fuel ratio in the exhaust gas may be rich regularly or irregularly without such a determination. As a method to make the air-fuel ratio of the exhaust gas rich, for example, low temperature combustion as mentioned later may be carried out in low engine load operating conditions such that the average air-fuel ratio becomes rich. Further, to make the air-fuel ratio of the exhaust gas rich, the combustion air-fuel ratio may be merely made rich. Further, in addition to the main fuel injection in the compression stroke, the fuel injector may inject fuel into the cylinder in the exhaust stroke or the expansion stroke (post-injection) or may injected fuel into the cylinder in the intake stroke (pre-injection). Of course, an interval between the post-injection or the pre-injection and the main fuel injection may not be provided. Further, fuel may be supplied to the exhaust system.

In high engine load operating conditions, a relatively high temperature exhaust gas is supplied to the particulate filter. Accordingly, the temperature (TF) of the particulate filter 22*a* rises by the high temperature exhaust gas and thus the particulates deposited on the particulate filter 22*a* are oxidized without producing luminous flame. On the other hand, in middle engine load operating conditions, the temperature of the exhaust gas supplied to the particulate filter 22*a* is lower than that in high engine load operating conditions. Therefore, in middle engine load operating conditions, the temperature (TF) of the particulate filter cannot rise, by the exhaust, high enough to oxidize the particulates deposited on the particulate filter without producing luminous flame. Accordingly, in the present embodiment, to oxidize the particulates deposited on the particulate filter 22*a* without luminous flame, a sub fuel injection is carried out and a time of the main fuel injection is delayed at this time. Thus, unburned fuel discharged from the combustion chamber burns in the exhaust passage and the temperature exhaust gas raised thereby is supplied to the particulate filter 22*a*.

By the way, fuel and lubricating oil include calcium Ca and thus the exhaust gas includes calcium Ca. When $SO_3$ exists, calcium Ca in the exhaust gas forms calcium sulfate $CaSO_4$. Calcium sulfate $CaSO_4$ is not oxidized and remains on the particulate filter as ash. To prevent blocking of the meshes of the particulate filter caused by calcium sulfate $CaSO_4$, an alkali metal or an alkali earth metal having an ionization tendency stronger than that of calcium Ca, such as potassium K may be used as the oxygen absorbing and active-oxygen releasing agent 61. Therefore, $SO_3$ diffused in the oxygen absorbing and active-oxygen releasing agent 61 is combined with potassium K to form potassium sulfate $K_2SO_4$ and thus calcium Ca is not combined with $SO_3$ but passes through the partition walls of the particulate filter. Accordingly, the meshes of the particulate filter are not blocked by the ash. Thus, it is desired to use, as the oxygen absorbing and active-oxygen releasing agent 61, an alkali metal or an alkali earth metal having an ionization tendency stronger than calcium Ca, such as potassium K, Lithium Li, cesium Cs, rubidium Rb, barium Ba or strontium Sr.

Figure 6B:
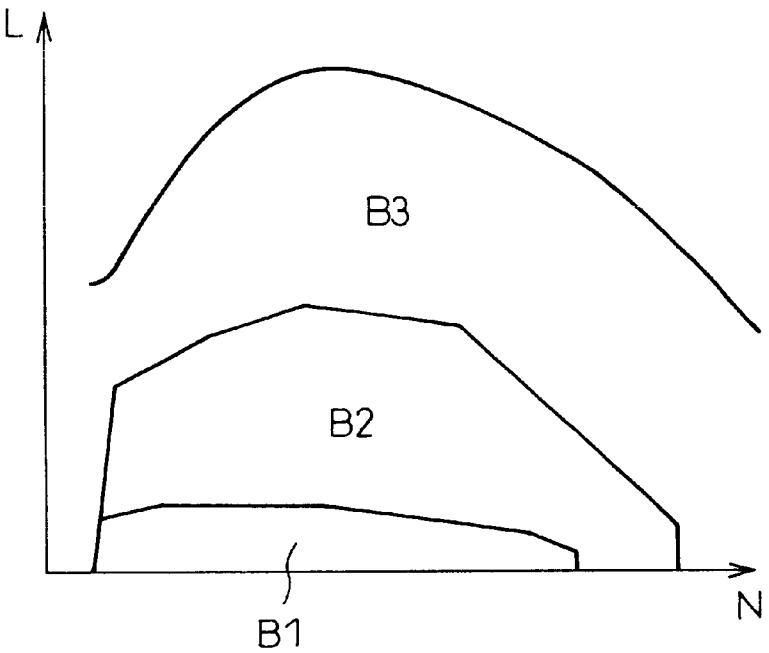
FIG. 6(B) is a view showing a second operating mode in which it is given priority to regenerate the particulate filter.
Figure 6A:
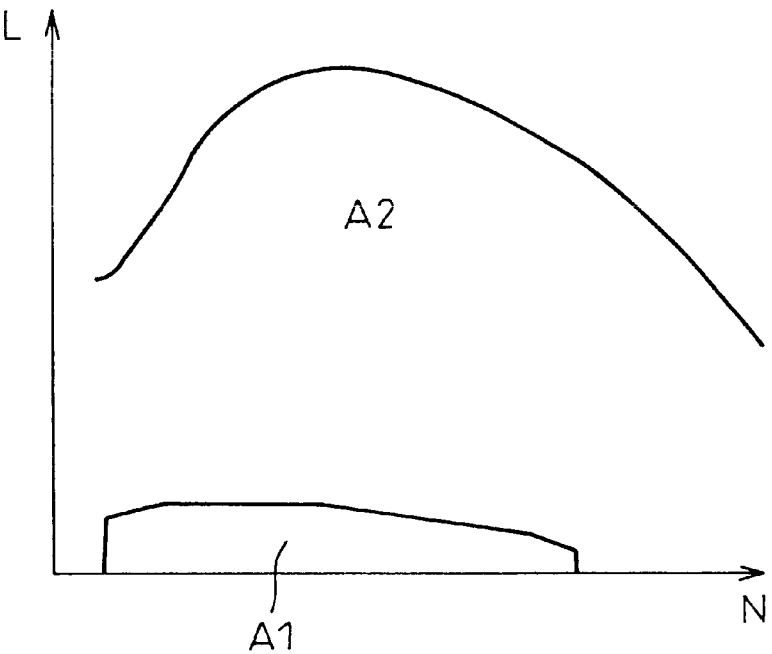
FIG. 6(A) is a view showing a first operating mode in which it is given priority to improve the fuel consumption rate of the engine.

FIG. 6 shows a first operating mode in which it is given priority to improve the fuel consumption rate of the engine and a second operating mode in which it is given priority to regenerate the particulate filter, i.e., to oxidize and remove the particulates on the particulate filter. FIG. 6(A) shows the first operating mode, and FIG. 6(B) shows the second operating mode. In FIGS. 6(A) and 6(B), the ordinate represents the required engine load (L), and the abscissa represents the engine speed (N). In the present embodiment, the first operating mode is usually selected. When the particulate filter 22*a* should be regenerated, the second operating is selected to oxidize and remove the particulates deposited on the particulate filter 22*a*.

As shown in FIG. 6(A), in the first operating mode, the whole operating area is divided into a low engine load operating area (A1) and a middle and high engine load operating area (A2). When the first operating mode is selected and the current engine operation is in the low engine load operating area (A1), low temperature combustion, as mentioned later, is carried out. Accordingly, the fuel consumption rate of the engine is improved and amounts of produced soot and produced NOx decrease simultaneously. On the other hand, when the first operating mode is selected and the current engine operation is in the middle and high engine operating area (A2), normal combustion, as mentioned later, is carried out. Accordingly, the fuel consumption rate of the engine is improved and amounts of produced soot and produced NOx decrease simultaneously.

As shown in FIG. 6(B), in the second operating mode, the whole operating area is divided into a low engine load operating area (B1), a middle engine load operating area (B2), and a high engine load operating area (B3). When the second operating mode is selected and the current engine operation is in the low engine load operating area (B1), the low temperature combustion is carried out similarly to in the first operating mode. Accordingly, the fuel consumption rate of the engine is improved and amounts of produced soot and produced $NO_x$ decrease simultaneously. Further, in the low temperature combustion, the combustion air-fuel ratio can be made rich. Therefore, as mentioned above, the oxygen concentration drops and the temperature of the particulate filter rises and thus an amount of active oxygen released from the oxygen absorbing and active-oxygen releasing agent increases so that the particulate filter can be regenerated favorably. On the other hand, when the second operating mode is selected and the current engine operation is in the middle engine operating area (B2), in the normal combustion as mentioned later, sub fuel injection is carried out in addition to the main fuel injection and the time of the main fuel injection is delayed. Therefore, all fuel injected in the sub fuel injection does not burn in the combustion chamber, a part of them is discharged from the combustion chamber as unburned fuel. Further, all fuel injected in the main fuel injection in which the injection time is delayed also does not burn in the combustion chamber. Thus, the air-fuel ratio in the exhaust gas is made rich and thus the particulate filter 22*a* is regenerated similarly to in the low engine load operating area (B1). When the second operating mode is selected and the current engine operation is in the high engine load operating area (B3), the normal combustion is carried out similarly to in the first operating mode. Accordingly, the fuel consumption rate of the engine is improved and amounts of produced soot and produced $NO_x$ decrease simultaneously. Further, in the high engine load operation, the temperature of the exhaust gas become high and thus the temperature of the particulate filter rises so that the particulate filter can be regenerated favorably.

Figure 7:
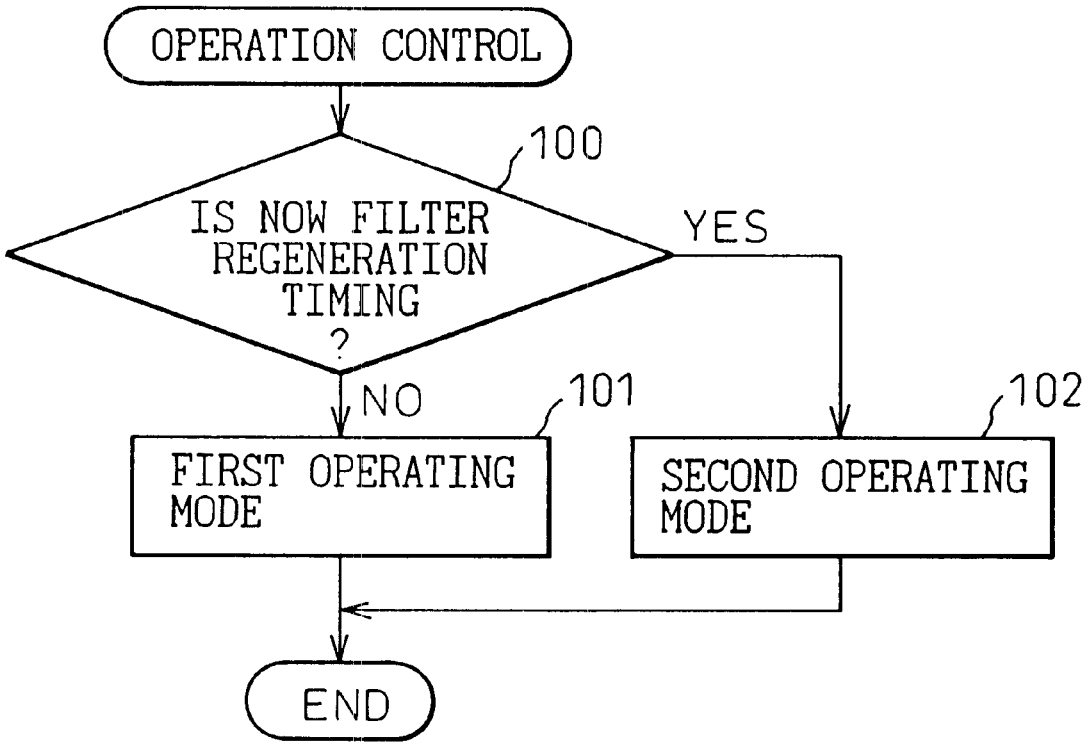
FIG. 7 is a flowchart showing an engine operation control method of an embodiment of the present invention.

FIG. 7 is a flowchart showing the engine operating mode control according to the present embodiment. As shown in FIG. 7, first, at step 100, it is determined if it is the time at which the particulate filter 22*a* should be regenerated. Concretely, when an amount of particulates deposited on the particulate filter 22*a* is estimated to be equal to or larger than a predetermined amount, it is determined that it is the time at which the particulate filter 22*a* should be regenerated. On the other hand, when an amount of particulates deposited on the particulate filter 22*a* is estimated to be smaller than the predetermined amount, it is determined that it is not the time at which the particulate filter 22*a* should be represented. In detail, when a first predetermined period on the basis of the capacity of the particulate filter 22*a* has elapsed during the engine operation in the first operating mode, an amount of particulates deposited on the particulate filter 22*a* is estimated to reach the predetermined amount. On the other hand, when a second predetermined period on the basis of the capacity of the particulate filter 22*a* has elapsed during the engine operation in the second operating mode, the regeneration of the particulate filter is estimated to be finished. Besides, when a vehicle with the engine has traveled over a predetermined distance during the engine operation in the first operating mode, an amount of particulates deposited on the particulate filter 22*a* may be estimated to reach the predetermined amount. Besides, a pressure sensor (not shown) is arranged immediately upstream the particulate filter 22*a* and when the exhaust back pressure detected by the pressure sensor rises, an amount of particulates deposited on the particulate filter 22*a* may be estimated to reach the predetermined amount. On the other hand, when the exhaust back pressure detected by the pressure sensor drops, the regeneration of the particulate filter may be estimated to be finished. At step 10C, when the result is "NO", the routine goes to step 101 and when the result is "YES", the routine goes to step 102. At step 101, the engine operation in the first operating mode shown in FIG. 6(A) is carried out. On the other hand, at step 102, the engine operation in the second operating mode shown in FIG. 6(B) is carried out.

Figure 8:
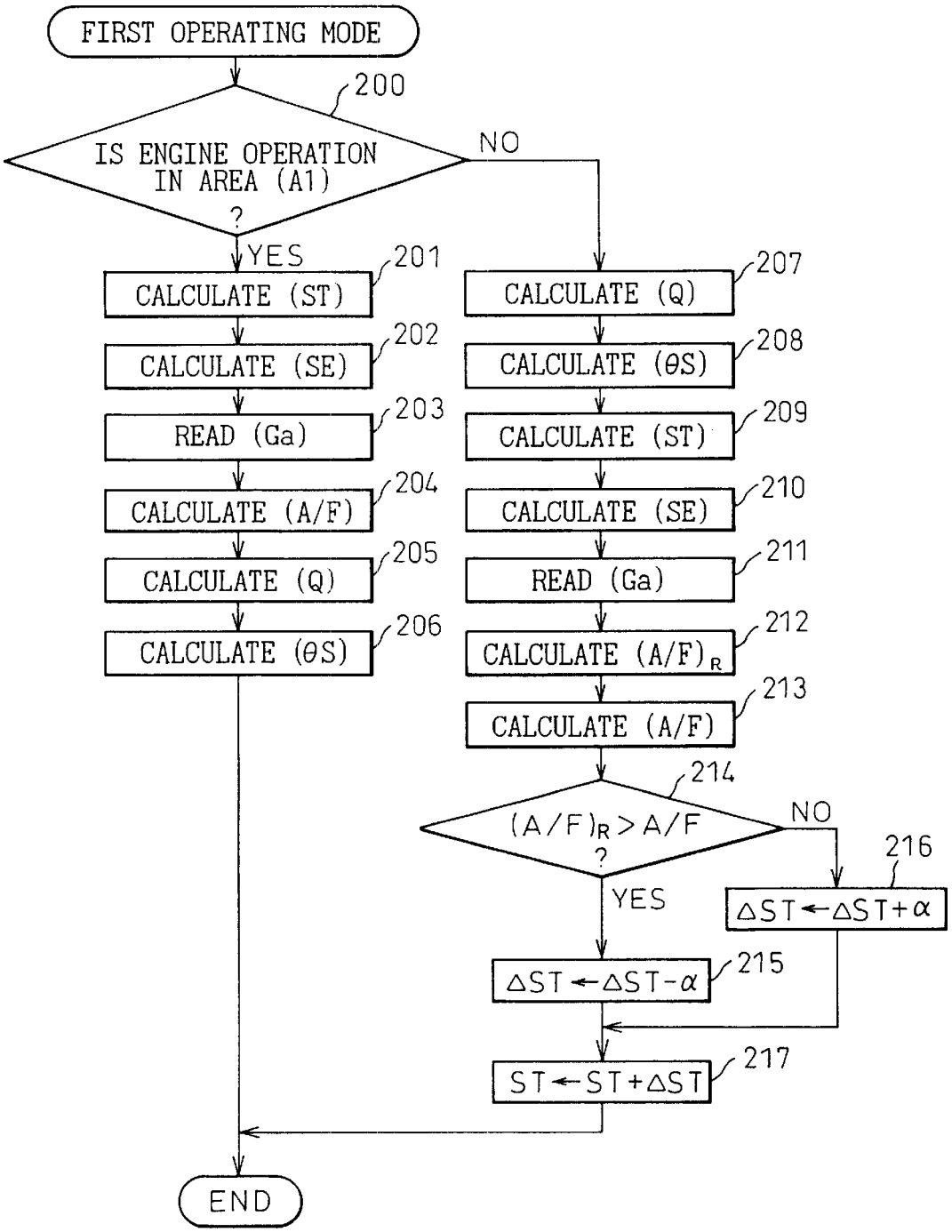
FIG. 8 is a flowchart showing a subroutine carried out at step 101 of FIG. 7.
Figure 10A:
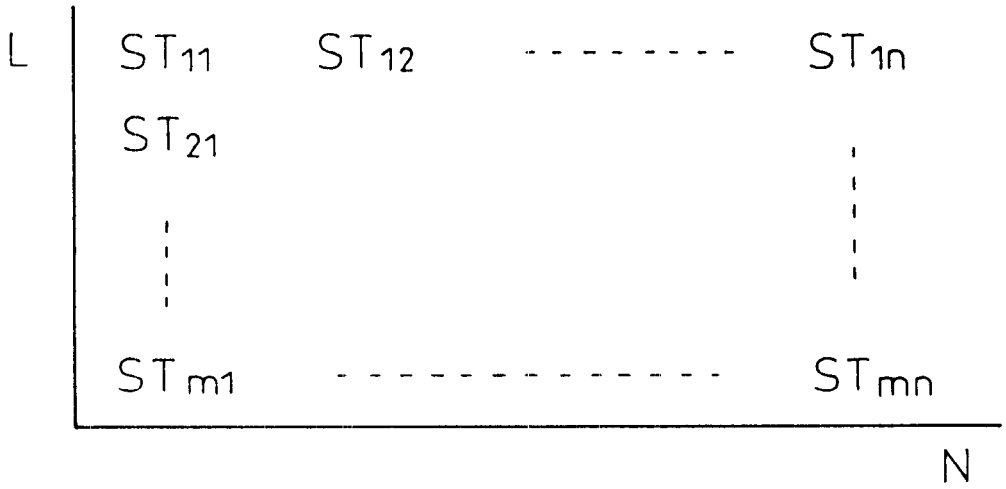
FIG. 10(A) is a map of target opening degrees of the throttle valve in the low engine load operating area (A1)
Figure 10B:
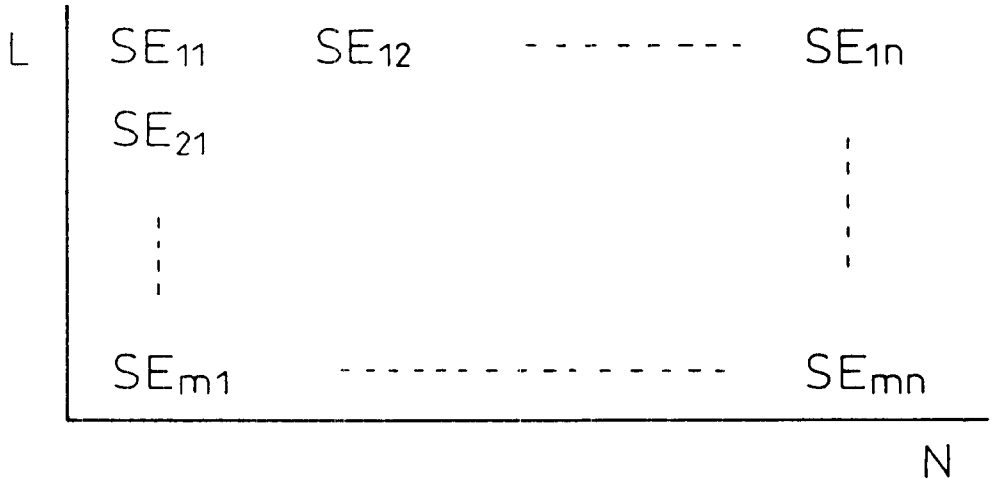
FIG. 10(B) is a map of target opening degrees of the EGR control valve in the low engine load operating area (A1)
Figure 11:
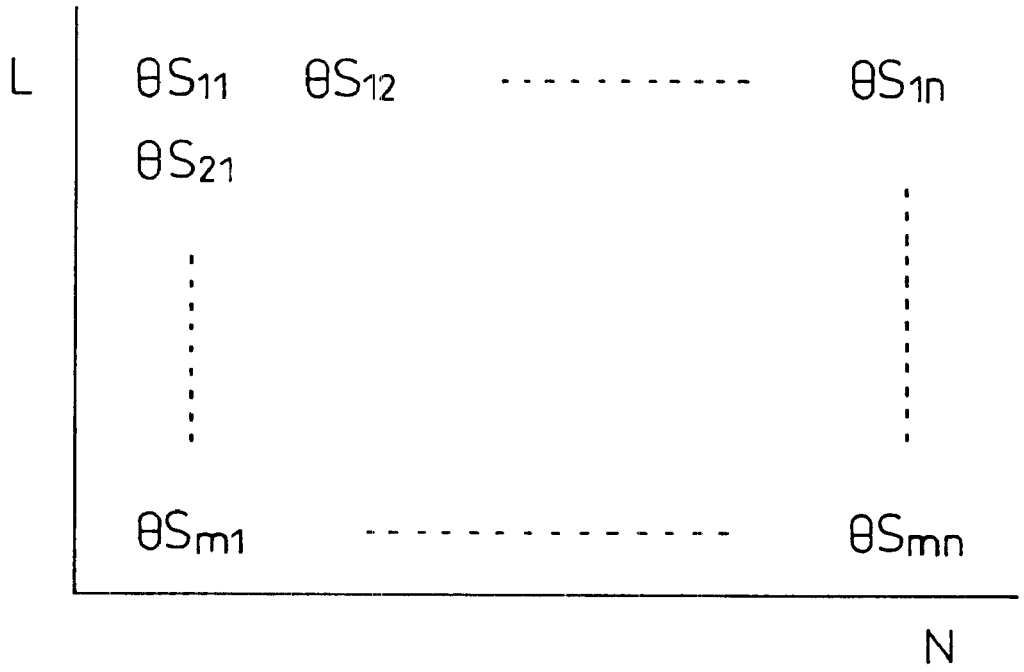
FIG. 11 is a map of target starting times of the fuel injection in the low engine load operating area (A1)

FIG. 8 is a flowchart showing a sub routine carried out at step 101 in FIG. 7. As shown in FIG. 8, first, at step 200, it is determined if the current engine operation is in the low engine load operating area (A1) of FIG. 6(A). When the result is "YES", the routine goes to step 201. On the other hand, when the result is "NO", the routine goes to step 207. At step 201, a target opening degree (ST) of the throttle valve 17 is calculated from a map shown in FIG. 10(A) and the throttle valve 17 is made the target opening degree (ST). Next, at step 202, a target opening degree (SE) of the EGR control valve 25 is calculated from a map shown in FIG. 10(B) and the EGR control valve 25 is made the target opening degree (SE). Next, at step 203, an amount of intake air (Ga) detected by the air-flow meter 44 is read and at step 204, a target air-fuel ratio A/F is calculated from a map shown in FIG. 9(B). Next, at step 205, an amount of injected fuel (Q) required to realize the target air-fuel ratio A/F is calculated on the basis of the amount of intake air (Ga). Next, at step 206, a target starting time (θS) of fuel injection is calculated from a map shown in FIG. 11.

Figure 9A:
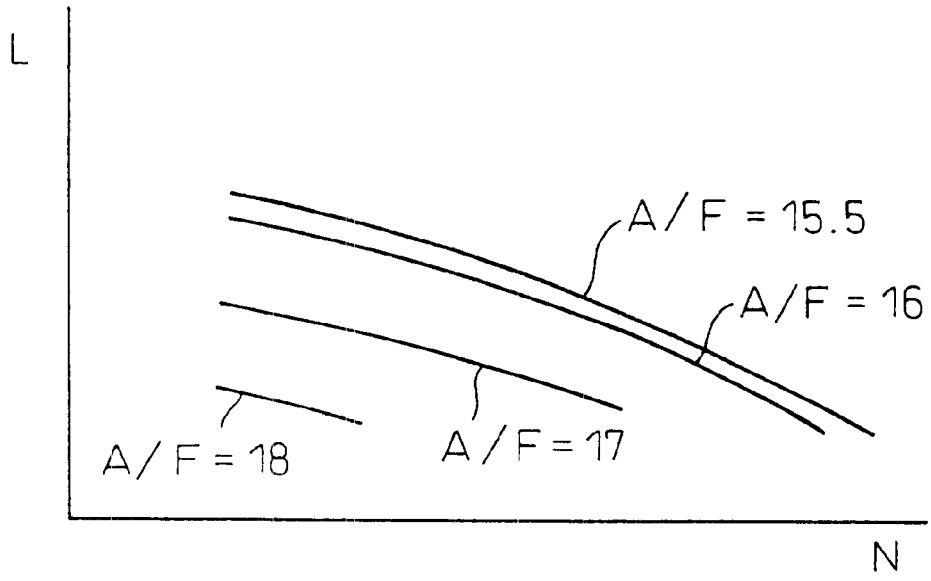
FIGS. 9(A) and 9(B) are views showing air-fuel ratios in a low engine load operating area (A1)

FIG. 9(A) shows target air-fuel ratios A/F in the low engine load operating area (A1). In FIG. 9(A), the curves indicated by A/F=15.5, A/F=16, A/F=17, and A/F=18 respectively show the cases where the air-fuel ratios are 15.5, 16, 17, and 18. The air-fuel ratio between two of the curves is defined by the proportional allotment. As shown in FIG. 9(A), in the low engine load operating area (A1), the air-fuel ratio is lean and the more the target air-fuel ratio A/F is lean, the lower the required engine load (L) becomes. That is, the amount of generated heat in the combustion decreases along with the decrease of the required engine load (L). Therefore, even if the EGR rate decreases along with the decrease of the required engine load (L), the low temperature combustion can be carried out. When the EGR rate decreases, the air-fuel ratio becomes large. Therefore, as shown in FIG. 9(A), the target air-fuel ratio A/F increases along with the decrease of the required engine load (L). The larger the target air-fuel ratio becomes, the more the fuel consumption rate is improved. Accordingly, in the present embodiment, the target air-fuel ratio A/F in increased along with the decrease in the required engine load (L) such that the air-fuel ratio is made as lean as possible.

Figure 9B:
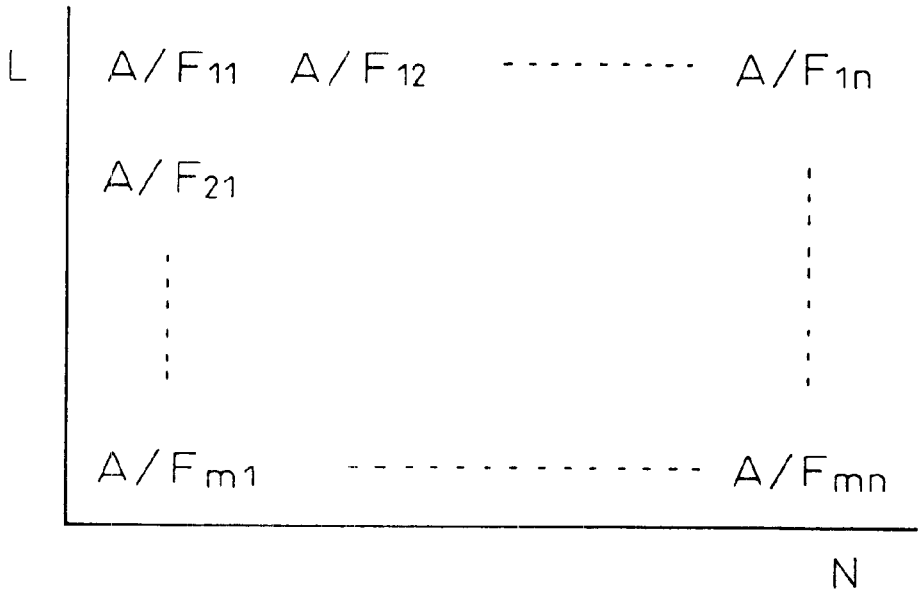

The target air-fuel ratio A/F shown in FIG. 9(A) is memorized in ROM 32 as the map shown in FIG. 9(B) in which it is a function of the required engine load (L) and the engine speed (N). The target opening degree (ST) of the throttle valve 17 required to make the air-fuel ratio the target air-fuel ratio A/F shown in FIG. 9(A) is memorized in ROM 32 the map shown in FIG. 10(A) in which it is a function of the required engine load (L) and the engine speed (N). The target opening degree (SE) of the EGR control valve 25 required to make the air-fuel ratio the target air-fuel ratio A/F shown in FIG. 9(A) is memorized in ROM 32 as the map shown in FIG. 10(B) in which it is a function of the required engine load (L) and the engine speed (N).

Figure 12A:
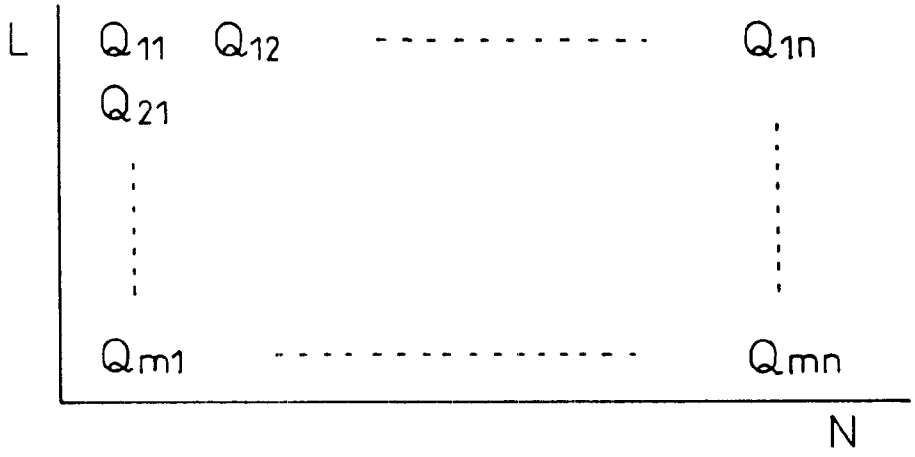
FIG. 12(A) is a map of target amounts of injected fuel in a middle and high engine load operating area (A2)

On the other hand, at step 207, a target amount of injected fuel (Q) is calculated from a map shown in FIG. 12(A) and an amount of injected fuel is made the target amount of injected fuel (Q). Note, at step 208, a target starting time (θS) of fuel injection is calculated from a map shown in FIG. 12(B) and a starting time of fuel injection is made the target starting time (θS). Next, at step 209, a target opening degree (ST) of the throttle valve 17 is calculated from a map shown in FIG. 14(A). Next, at step 210, a target opening degree (SE) of the EGR control valve 25 is calculated from a map shown in FIG. 14(B) and an opening degree of the EGR control valve 25 is made the target opening degree (SE). At step 211, an amount of intake air (Ga) detected by the air-flow meter 44 is read. Next, at step 212, the actual air-fuel ratio $(A/F)_R$ is calculated on the basis of the amount of injected fuel (Q) and the amount of intake air (Ga). At step 213, a target air-fuel ratio A/F is calculated from a map shown in FIG. 13(B). Next, at step 214, it is determined if the actual air-fuel ratio $(A/F)_R$ is larger than the target air-fuel ratio A/F. When $(A/F)_R$ is larger than A/F, the routine goes to step 215 and a correction value of the opening degree of the throttle valve (ΔST) is decreased by a constant (α) and the routine goes to step 217. On the other hand, when $(A/F)_R$ is equal to or smaller than A/F, the routine goes to step 216 and the correction value (ΔST) is increased by a constant (α) and the routine goes to step 217. At step 217, a final opening degree (ST) of the throttle valve 17 is calculated such that the correction value (ΔST) is added to the target opening degree (ST) and an opening degree of the throttle valve 17 is made the final opening degree (ST). That is, an opening degree of the throttle valve 17 is controlled such that the actual air-fuel ratio $(A/F)_R$ is made the target air-fuel ratio A/F.

Figure 12B:
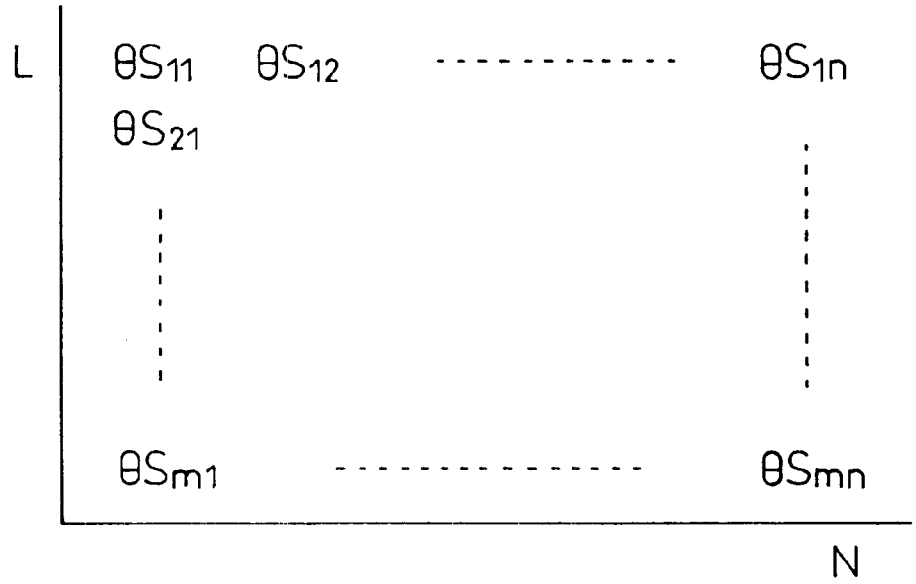
FIG. 12(B) is a map of target starting times of fuel injection in the middle and high engine load operating area (A2)
Figure 13A:
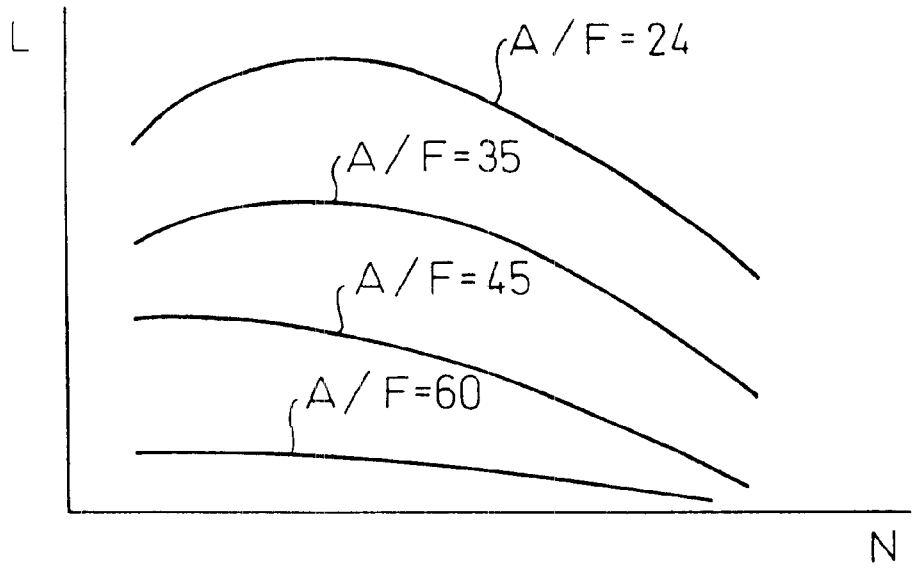
FIGS. 13(A) and 13(B) are views showing air-fuel ratios in the middle and high engine load operating area (A2)

FIG. 13(A) shows target air-fuel ratios when the normal combustion is carried out. In FIG. 13(A), the curves indicated by A/F=24, A/F=35, A/F=45, and A/F=60 shows respectively the cases in that the target air-fuel ratios are 24, 35, 45, and 60. A target air-fuel ratio A/F shown in FIG. 13(A) is memorized in ROM 32 as the map shown in FIG. 13(B) in which it is a function of the required engine load (L) and the engine speed (N). A target opening degree (ST) of the throttle valve 17 required to make the air-fuel ratio the target air-fuel ratio A/F is memorized in ROM 32 as the map shown in 14(A) in which it is a function of the required engine load (L) and the engine speed (N). A target opening degree (SE) of the EGR control valve 25 required to make the air-fuel ratio the target air-fuel ratio A/F is memorized in ROM 32 as the map shown in FIG. 14(B) in which it is a function of the required engine load (L) and the engine speed (N). Besides, when the normal combustion is carried out, an amount of injected fuel (Q) is calculated on the basis of the required engine load (L) and the engine speed (N). The amount of injected fuel (Q) is memorized in ROM 32 as the map shown in FIG. 12(A) in which it is a function of the required engine load (L) and the engine speed (N). Similarly, when the normal combustion is carried out, a starting time (θS) of fuel injection is calculated on the basis of the required engine load (L) and the engine speed (N). The starting time (θS) is memorized in ROM 32 as the map shown in FIG. 12(B) in which it is a function of the required engine load (L) and the engine speed (N).

Figure 15:
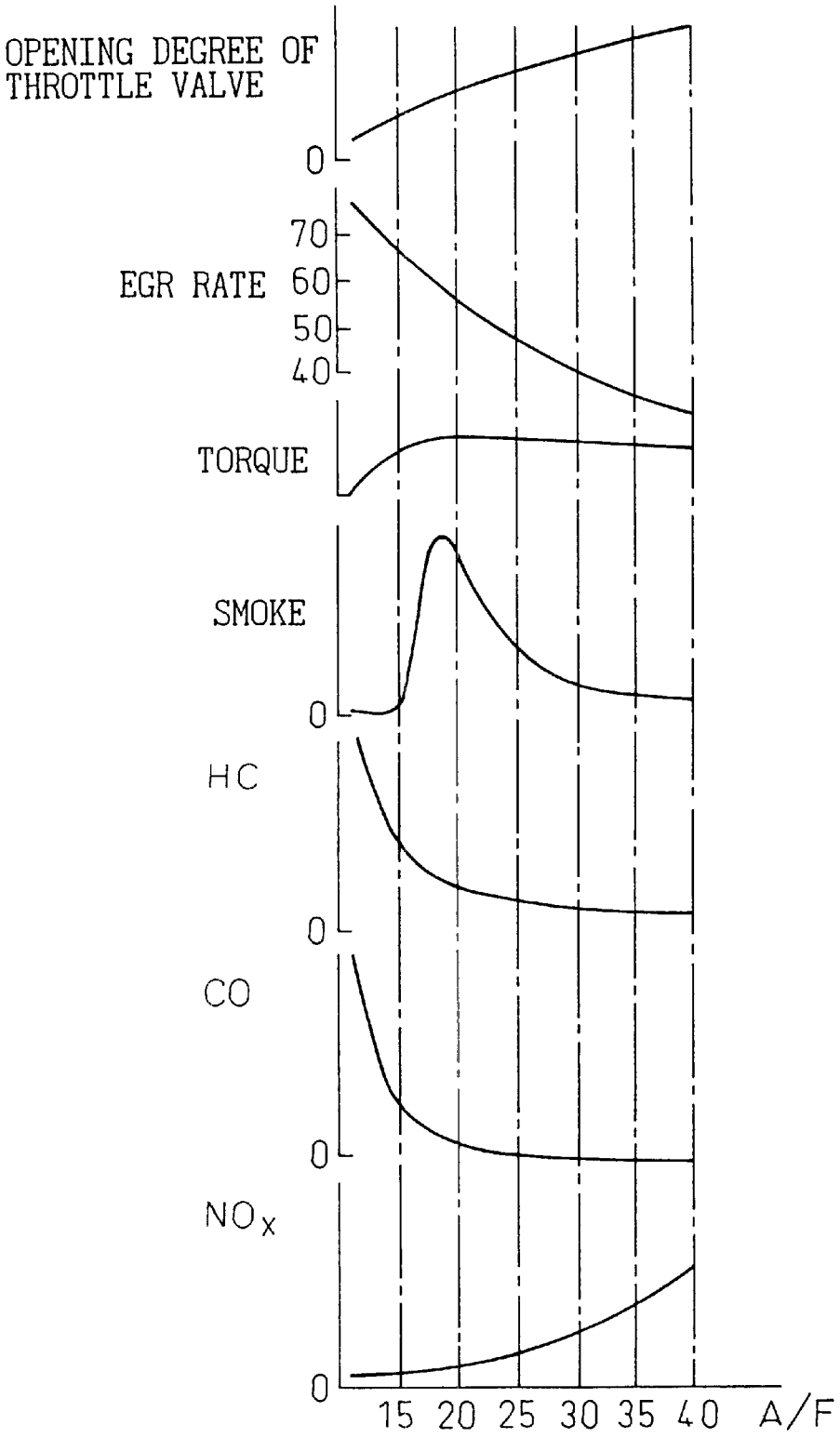

Next, the low temperature combustion is explained in detail. FIG. 15 indicates an example of an experiment showing the changing in the output torque and the amount of smoke, HC, CO, and $NO_x$ exhausted at that time when changing the air-fuel ratio A/F (abscissa in FIG. 15) by changing the opening degree of the throttle valve 17 and the EGR rate at the time of low engine load operation. As will be understood from FIG. 15, in this experiment, the smaller the air-fuel ratio A/F becomes, the larger the EGR rate becomes. When the air-fuel ratio is below the stoichiometric air-fuel ratio (nearly equal 14.6), the EGR rate becomes over 65 percent. As shown in FIG. 15, if the EGR rate is increased to reduce the air-fuel ratio A/F, when the EGR rate becomes close to 40 percent and the air-fuel ratio AVF becomes about 30, the amount of produced smoke starts to increase. Next, when the EGR rate is further increased and the air-fuel ratio A/F is made smaller, the amount of produced smoke sharply increases and peaks. Next, when the EGR rate is further increased and the air-fuel ratio A/F is made smaller, the amount of produced smoke sharply decreases. When the EGR rate is made over 65 percent and the air-fuel ratio A/F becomes close to 15.0, the amount of produced smoke is substantially zero. That is, almost no soot is produced. At this time, the output torque of the engine falls somewhat and the amount of produced $NO_x$ becomes considerably lower. On the other hand, at this time, the amounts of produced BC and CO start to increase.

Figure 16A:
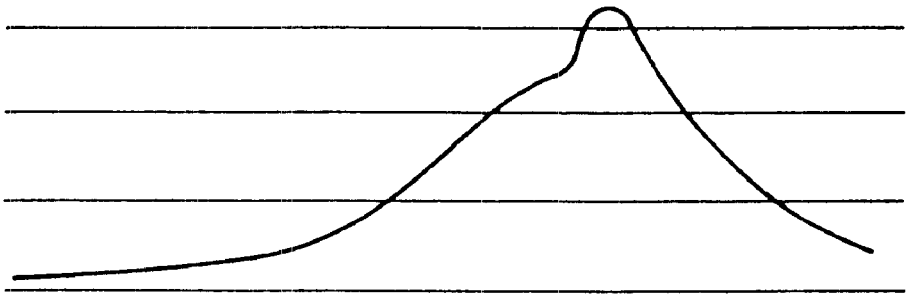
FIGS. 16(A) and 16(B) are views showing the combustion pressure.
Figure 16B:
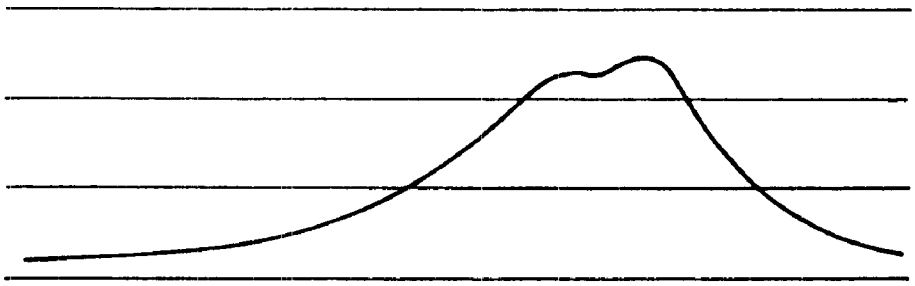

FIG. 16(A) shows the changes in combustion pressure in the combustion chamber 5 when the amount of produced smoke is the greatest near an air-fuel ratio A/F of 21. FIG. 16(B) shows the changes in combustion pressure in the combustion chamber 5 when the amount of produced smoke is substantially zero near an air-fuel ratio A/F of 18. As will be understood from a comparison of FIG. 16(A) and FIG. 16(B), the combustion pressure is lower in the case shown in FIG. 16(B) where the amount of produced smoke is substantially zero than the case shown in FIG. 16(A) where the amount of produced smoke is large.

The following may be said from the results of the experiment shown in FIGS. 15 and 16. That is, first, when the air-fuel ratio A/F is less than 15.0 and the amount of produced smoke is substantially zero, the amount of produced $NO_x$ decreases considerably as shown in FIG. 15. The fact that the amount of produced $NO_x$ decreases means that the combustion temperature in the combustion chamber 5 falls. Therefore, it can be said that when almost no soot is produced, the combustion temperature in the combustion chamber 5 becomes lower. The same fact can be said from FIG. 16. That is, in the state shown in FIG. 16(B) where almost no soot is produced, the combustion pressure becomes lower, therefore the combustion temperature in the combustion chamber 5 becomes lower at this time.

Figure 17:
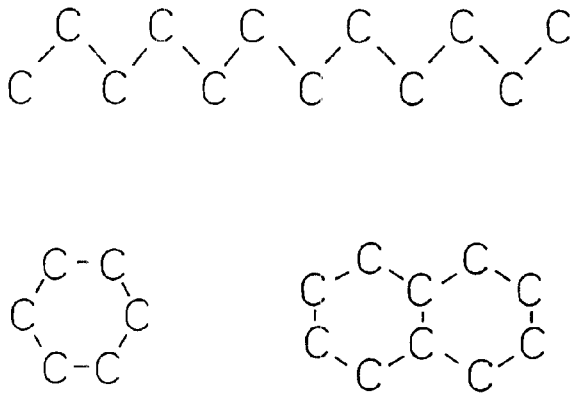
FIG. 17 is a view showing the fuel molecules.

Second, when the amount of produced smoke, that is, the amount of produced soot, becomes substantially zero, as shown in FIG. 15, the amounts of exhausted HC and CO increase. This means that the hydrocarbons are exhausted without changing into soot. That is, the straight chain hydrocarbons and aromatic hydrocarbons contained in the fuel and shown in FIG. 17 decompose when raised in temperature in an oxygen insufficient state resulting in the formation of a precursor of soot. Next, soot mainly composed of solid masses of carbon atoms is produced. In this case, the actual process of production of soot is complicated. How the precursor of soot is formed is not clear, but whatever the case, the hydrocarbons shown in FIG. 17 change to soot through the soot precursor. Therefore, as explained above, when the amount of production of soot becomes substantially zero, the amount of exhaust of HC and CO increases as shown in FIG. 15, but the HC at this time is a soot precursor or in a state of hydrocarbon before that. The HC burns in the exhaust system and the temperature of the exhaust gas rises.

Summarizing these considerations based on the results of the experiments shown in FIGS. 15 and 16, when the combustion temperature in the combustion chamber 5 is low, the amount of produced soot becomes substantially zero. At this time, a soot precursor or a state of hydrocarbons before that is exhausted from the combustion chamber 5. More detailed experiments and studies were conducted. As a result, it was learned that when the temperature of the fuel and the gas around the fuel in the combustion chamber 5 is below a certain temperature, the process of growth of soot stops midway, that is, no soot at all is produced and that when the temperature of the fuel and the gas around the fuel in the combustion chamber 5 becomes higher than the certain temperature, soot is produced.

The temperature of the fuel and the gas around the fuel when the process of growth of hydrocarbons stops in the state of the soot precursor, that is, the above certain temperature, changes depending on various factors such as the type of the fuel, the air-fuel ratio, and the compression ratio, so it cannot be said exactly what it is, but this certain temperature is deeply related to the amount of production of $NO_x$. Therefore, this certain temperature can be defined to a certain degree from the amount of production of $NO_x$. That is, the greater the EGR rate is, the lower the temperature of the fuel, and the gas around it at the time of combustion, becomes and the lower the amount of produced $NO_x$ becomes. At this time, when the amount of produced $NO_x$ becomes around 10 ppm or less, almost no soot is produced any more. Therefore, the above certain temperature substantially corresponds to the temperature when the amount of produced $NO_x$ becomes around 10 ppm or less.

Once soot is produced, it is impossible to purify it by after-treatment using a catalyst having an oxidation function. As opposed to this, a soot precursor or a state of hydrocarbons before that can be easily purified by after-treatment using a catalyst having an oxidation function. Thus, it is extremely effective for the purifying of the exhaust gas that the hydrocarbons are exhausted from the combustion chamber 5 in the form of a soot precursor or a state before that with the reduction of the amount of produced $NO_x$.

Now, to stop the growth of hydrocarbons in the state before the production of soot, it is necessary to suppress the temperature of the fuel and the gas around it at the time of combustion in the combustion chamber 5 to a temperature lower than the temperature where soot is produced. In this case, it was learned that the heat absorbing action of the gas around the fuel at the time of combustion of the fuel has an extremely great effect in suppression the temperatures of the fuel and the gas around it. That is, if only air exists around the fuel, the vaporized fuel will immediately react with the oxygen in the air and burn. In this case, the temperature of the air away from the fuel does not rise so much. Only the temperature around the fuel becomes locally extremely high. That is, at this time, the air away from the fuel does not absorb the heat of combustion of the fuel much at all. In this case, since the combustion temperature becomes extremely high locally, the unburned hydrocarbons receiving the heat of combustion produce soot.

On the other hand, when fuel exists in a mixed gas of a large amount of inert gas and a small amount of air, the situation is somewhat different. In this case, the evaporated fuel disperses in the surroundings and reacts with the oxygen mixed in the inert gas to burn. In this case, the heat of combustion is absorbed by the surrounding inert gas, so the combustion temperature no longer rises so much. That is, the combustion temperature can be kept low. That is, the presence of inert gas plays an important role in the suppression of the combustion temperature. It is possible to keep the combustion temperature low by the heat absorbing action of the inert gas.

In this case, to suppress the temperature of the fuel and the gas around it to a temperature lower than the temperature at which soot is produced, an amount of inert gas enough to absorb an amount of heat sufficient for lowering the temperature is required. Therefore, if the amount of fuel increases, the amount of required inert gas increases. Note that, in this case, the larger the specific heat of the inert gas is, the stronger the heat absorbing action becomes. Therefore, a gas with a large specific heat is preferable as the inert gas. In this regard, since $CO_2$ and EGR gas have relatively large specific heats, it may be said to be preferable to use EGR gas as the inert gas.

Figure 18:
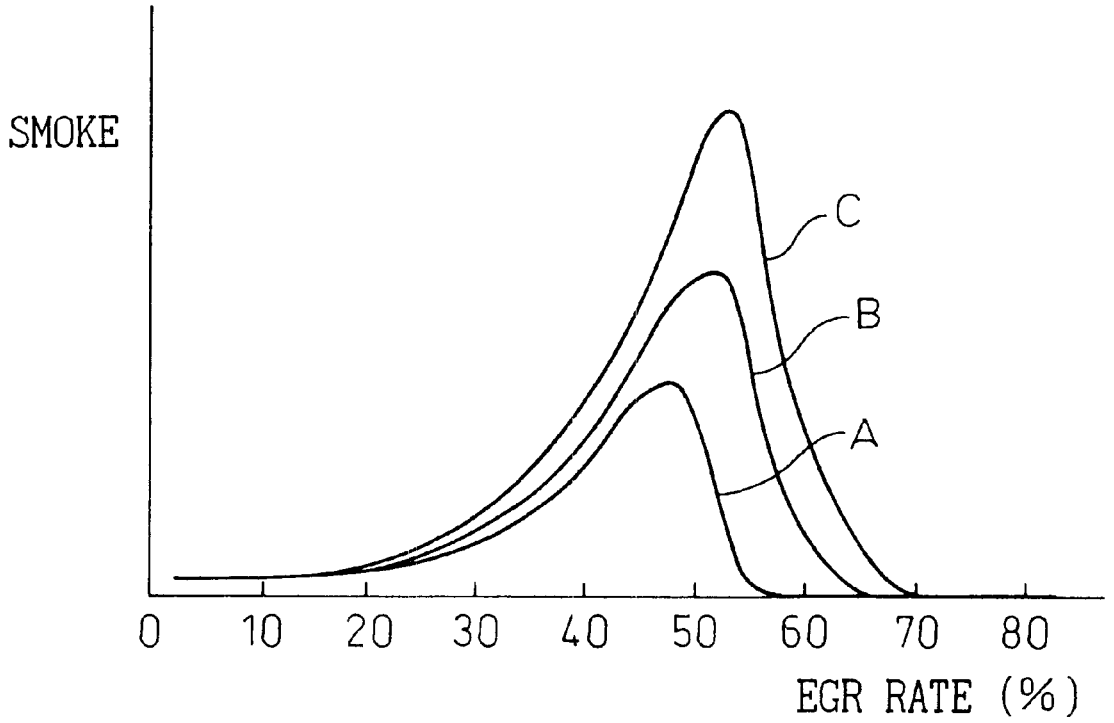
FIG. 18 is a view showing the relationship between the amount of produced smoke and the EGR rate.

FIG. 18 shows the relationship between the EGR rate and smoke when using EGR gas as the inert gas and changing the degree of cooling of the EGR gas. That is, the curve (A) in FIG. 18 shows the case of strongly cooling the EGR gas and maintaining the temperature of the EGR gas at about 90 degrees C., the curve (B) shows the case of cooling the EGR gas by a compact cooling apparatus, and the curve (C) shows the case of not compulsorily cooling the EGR gas. When strongly cooling the EGR gas, as shown by the curve (A) in FIG. 18, the amount of produced soot peaks when the EGR rate is a slightly below 50 percent. In this case, if the EGR rate is made about 55 percent or higher, almost no soot is produced any longer. On the other hand, when the EGR gas is slightly cooled as shown by the curve (B) in FIG. 18, the amount of produced soot peaks when the EGR rate is slightly higher than 50 percent. In this case, if the EGR rate is made above about 65 percent, almost no soot is produced. Further, when the EGR gas is not forcibly cooled as shown by the curve (C) in FIG. 18, the amount of produced soot peaks near an EGR rate of 55 percent. In this case, if the EGR rate is made over about 70 percent, almost no soot is produced. Note that FIG. 18 shows the amount of produced smoke when the engine load is relatively high. When the engine load becomes smaller, the EGR rate at which the amount of produced soot peaks falls somewhat, and the lower limit of the EGR rate, at which almost no soot is produced, also falls somewhat. In this way, the lower limit of the EGR rate at which almost no soot is produced changes in accordance with the degree of cooling of the EGR gas or the engine load.

Figure 19:
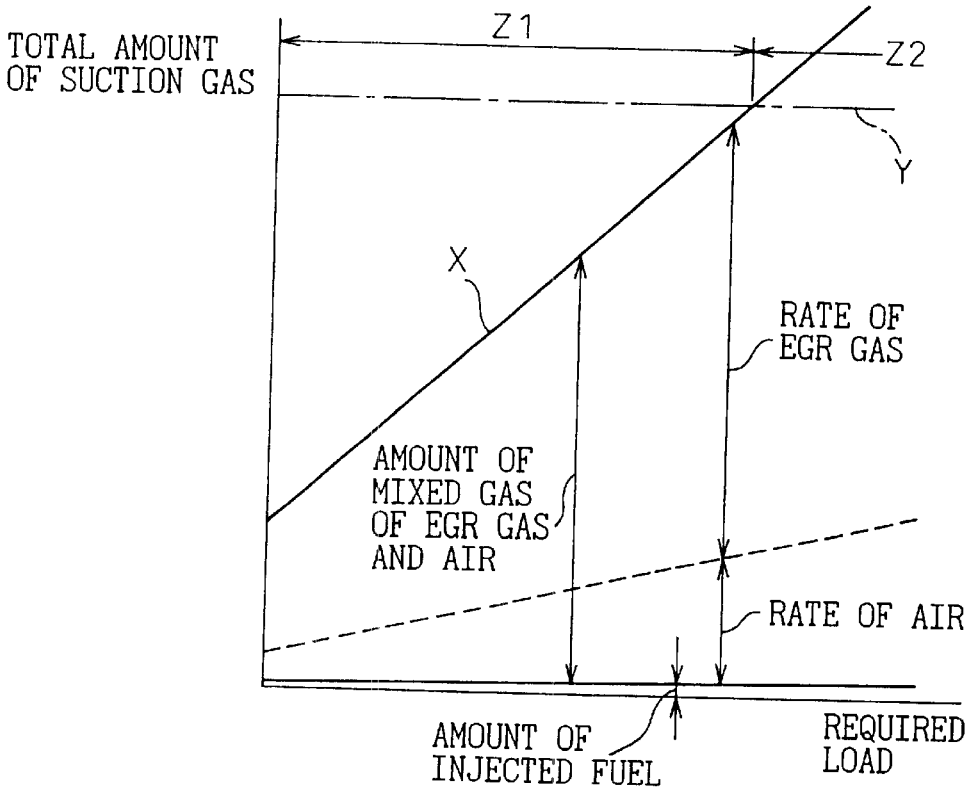
FIG. 19 is a view showing the relationship between the amount of injected fuel and the amount of mixed gas.

FIG. 19 shows the amount of mixed gas of EGR gas and air, the ratio of air in the mixed gas, and the ratio of EGR gas in the mixed gas, required to make the temperature of the fuel and the gas around it, at the time of combustion, a temperature lower than the temperature at which soot is produced in the case of the use of EGR gas as an inert gas. Note that, in FIG. 19, the ordinate shows the total amount of suction gas taken into the combustion chamber 5. The broken line (Y) shows the total amount of suction gas able to be taken into the combustion chamber 5 when supercharging is not being performed. Further, the abscissa shows the required load. (Z1) shows the low engine load operation region.

Referring to FIG. 19, the ratio of air, that is, the amount of air in the mixed gas shows the amount of air necessary for causing the injected fuel to completely burn. That is, in the case shown in FIG. 19, the ratio of the amount of air and the amount of injected fuel becomes the stoichiometric air-fuel ratio. On the other hand, in FIG. 19, the ratio of EGR gas, that is, the amount of EGR gas in the mixed gas, shows the minimum amount of EGR gas required for making the temperature of the fuel, and the gas around it, a temperature lower than the temperature at which soot is produced when the injected fuel has burned completely. This amount of EGR gas is, expressed in term of the EGR rate, equal to or larger than 55 percent, in the embodiment shown in FIG. 19, it is equal to or larger than 70 percent. That is, if the total amount of suction gas taken into the combustion chamber 5 is made the solid line (X) in FIG. 15 and the ratio between the amount of air and the amount of EGR gas in the total amount of suction gas (X) is made the ratio shown in FIG. 19, the temperature of the fuel and the gas around it becomes a temperature lower than the temperature at which soot is produced and therefore no soot at all is produced any longer. Further, the amount of produced $NO_x$ at this time is about 10 ppm or less and therefore the amount of produced $NO_x$ becomes extremely small.

If the amount of injected fuel increases, the amount of heat generated at the time of combustion increases, so to maintain the temperature of the fuel and the gas around it at a temperature lower than the temperature at which soot is produced, the amount of heat absorbed by the EGR gas must be increased. Therefore, as shown in FIG. 19, the amount of EGR gas has to be increased with an increase in the amount of injected fuel. That is, the amount of EGR gas has to be increased as the required engine load becomes higher. On the other hand, in the engine load region (Z2) of FIG. 19, the total amount of suction gas (X) required for inhibiting the production of soot exceeds the total amount of suction gas (Y) that can be taken in. Therefore, in this case, to supply the total amount of suction gas (X), required for inhibiting the production of soot, into the combustion chamber 5, it is necessary to supercharge or pressurize both the EGR gas and the intake air or just the EGR gas. When not supercharging or pressurizing the EGR gas etc., in the engine load region (Z2), the total amount of suction gas (X) corresponds to the total amount of suction gas (Y) that can be taken in. Therefore, in this case, to inhibit the production of soot, the amount of air is reduced somewhat to increase the amount of EGR gas and the fuel is made to burn in a state where the air-fuel ratio is rich.

As explained above, FIG. 19 shows the case of combustion of fuel at the stoichiometric air-fuel ratio. In the low engine load operating region (Z1) shown in FIG. 10, even if the amount of air is made smaller than the amount of air shown in FIG. 19, that is, even if the air-fuel ratio is made rich, it is possible to inhibit the production of soot and make the amount of produced $NO_x$ around 10 ppm or less. Further, in the low engine load operating region (Z1) shown in FIG. 19, even if the amount of air is made greater than the amount of air shown in FIG. 19, that is, the average of air-fuel ratio is made lean of 17 to 18, it is possible to inhibit the production of soot and make the amount of produced $NO_x$ around 10 ppm or less.

That is, when the air-fuel ratio is made rich, the fuel is in excess, but since the combustion temperature is suppressed to a low temperature, the excess fuel does not change into soot and therefore soot is not produced. Further, at this time, only an extremely small amount of $NO_x$ is produced. On the other hand, when the average of air-fuel ratio is lean or when the air-fuel ratio is the stoichiometric air-fuel ratio, a small amount of soot is produced if the combustion temperature becomes higher, but the combustion temperature is suppressed to a low temperature, and thus no soot at all is produced. Further, only an extremely small amount of $NO_x$ is produced.

In this way, in the low engine load operating region (Z1), despite the air-fuel ratio, that is, whether the air fuel ratio is rich or the stoichiometric air-fuel ratio, or the average of air-fuel ratio is lean, no soot is produced and the amount of produced $NO_x$ becomes extremely small. Therefore, considering the improvement of the fuel consumption rate, it may be said to be preferable to make the average of air-fuel ratio lean.

By the way, only when the engine load is relative low and the amount of generated heat is a small, can the temperature of the fuel and the gas around the fuel in the combustion be suppressed to below a temperature at which the process of growth of soot stops midway. Therefore, in the embodiment of the present invention, when the engine load is relative low, the temperature of the fuel and the gas around the fuel in the combustion is suppressed to below a temperature at which the process of growth of soot stops midway and thus a first combustion, i.e., a low temperature combustion is carried out. When the engine load is relative high, a second combustion, i.e., normal combustion as usual is carried out. Here, as can be understood from the above explanation, the low temperature combustion is a combustion in which the amount of inert gas in the combustion chamber is larger than the worst amount of inert gas causing the maximum amount of produced soot and thus no soot at all is produced. The normal combustion is a combustion in which the amount of inert gas in the combustion chamber is smaller than the worst amount of inert gas.

Figure 20:
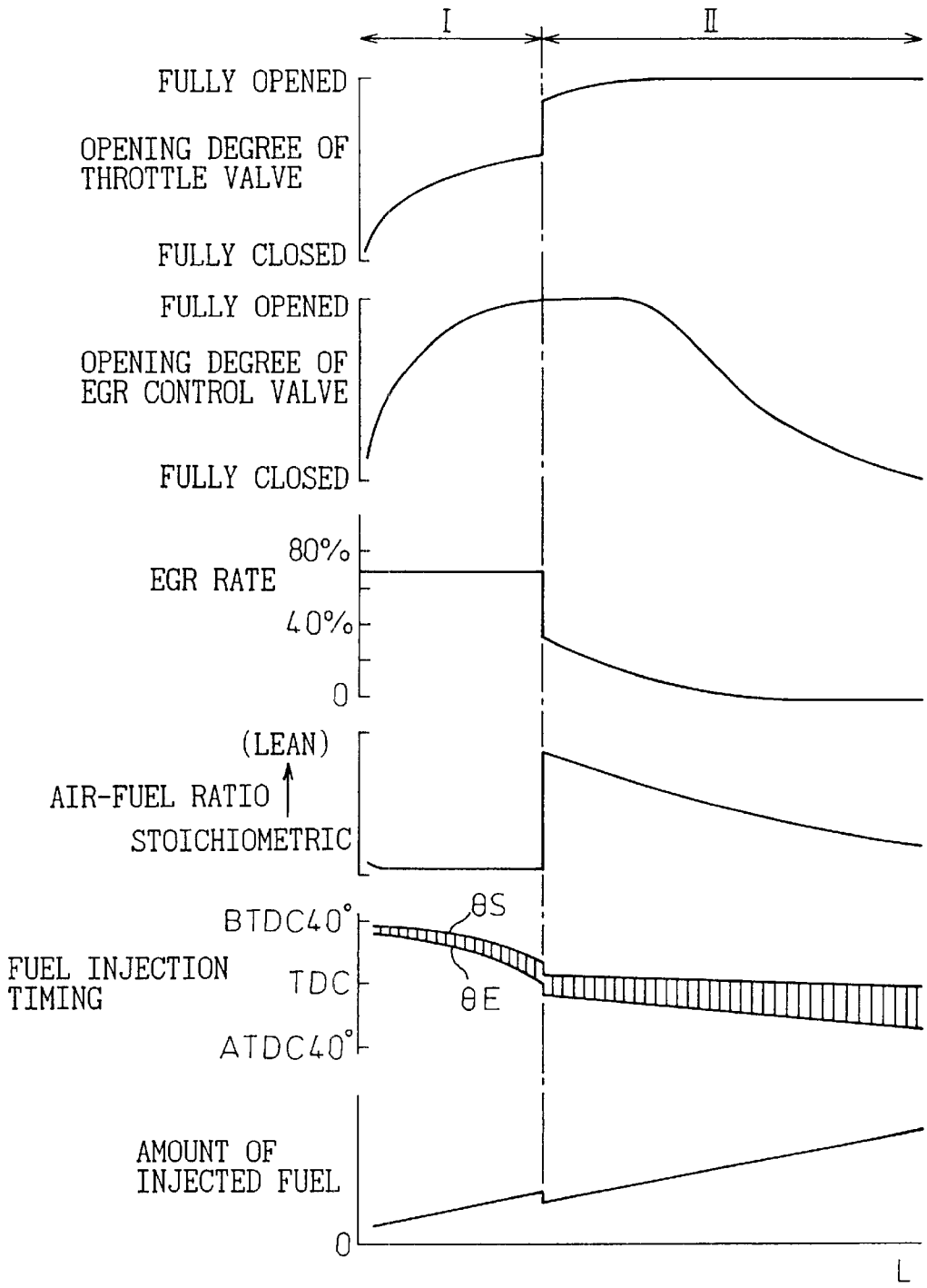
FIG. 20 is a view showing the opening degree of the throttle valve, the opening degree of the EGR control valve, the EGR rate, the air-fuel ratio, the fuel injection timing, and the amount of injected fuel, to the required engine load.

Next, referring FIG. 20, the engine operating control is explained in the low engine load operating area (A1) and the middle engine load operating area (A2) shown in FIG. 6(A). FIG. 20 shows the opening degree of the throttle valve 17, the opening degree of the EGR control valve 25, the EGR rate, the air-fuel ratio, the fuel injection timing, and the amount of injected fuel with respect to the required engine load (L). As shown in FIG. 20, in the low engine load operating area (A1) when the required engine load (L) is low, the throttle valve 17 is gradually opened from near the fully closed state to near the two third opened state along with the increase of the required engine load (L), and the EGR control valve 25 is gradually opened from near the fully closed state to the fully opened state along with the increase in the required engine load (L). In the embodiment shown in FIG. 20, the EGR rate in the low engine load operating area (A1) is made about 70 percent and the air-fuel ratio therein is made slightly lean.

In the other words, in the low engine load operating area (A1), the opening degrees of the throttle valve 17 and the EGR control valve 25 are controlled such that the EGR rate becomes about 70 percent and the air-fuel ratio becomes a slightly lean air-fuel ratio. The air-fuel ratio at this time is controlled to the target air-fuel ratio to correct the opening degree of the EGR control valve 25 on the basis of the output signal of the air-fuel ratio sensor 21. In the low engine load operating area (A1), the fuel is injected before the compression top dead center TDC. In this case, the starting time (θS) of fuel injection is delayed along with the increase of the required engine load (L) and the ending time (θE) of fuel injection is delayed along with the delay of the starting time (θS) of fuel injection. When in the idle operation, the throttle valve 17 is closed to near the fully closed state. In this time, the EGR control valve 25 is also closed to near the fully closed state. When the throttle valve 17 is closed near the fully closed state, the pressure in the combustion chamber 5 in the initial stage of the compression stroke is made low and thus the compression pressure becomes low. When the compression pressure becomes low, the compression work of the piston 4 becomes small and thus the vibration of the engine body 1 becomes small. That is, when in the idle operation, the throttle valve 17 is closed near the fully closed state to restrain the vibration of the engine body 1.

On the other hand, when the engine operating area is changed from the low engine load operating area (A1) to the middle engine load operating area (A2), the opening degree of the throttle valve 17 increases by a step from the two-thirds opened state toward the fully opened state. At this time, in the embodiment shown in FIG. 20, the EGR rate decreases by a step from about 70 percent to below 40 percent and the air-fuel ratio increases by a step. That is, the EGR rate jumps beyond the EGR rate extent (FIG. 18) in which the large amount of smoke is produced and thus the large amount of smoke is not produced when the engine operating region changes from the low engine load operating area (A1) to the middle engine load operating area (A2). In the middle engine load operating area (A2), the normal combustion as usual is carried out. This combustion causes some production of soot and $NO_x$. However, the thermal efficiency thereof is higher than that of the low temperature combustion. Thus, when the engine operating area changes from the low engine load operating area (A1) to the middle engine load operating area (A2), the amount of injected fuel decreases by a step as shown in FIG. 20. In the middle engine load operating area (A2), the throttle valve 17 is held in the fully opened state except in a part thereof. The opening degree of the EGR control valve 25 decreases gradually along with the increase of the required engine load (L). In this middle engine load operating area (A2), the EGR rate decreases along with the increase of the required engine load (L) and the air-fuel ratio decreases along with the increase of the required engine load (L). However, the air-fuel ratio is made a lean air-fuel ratio even if the required engine load (L) becomes high. Further, in the middle engine load operating area (A2), the starting time (θS) of fuel injection is made near the compression top dead center TDC.

Figure 21:
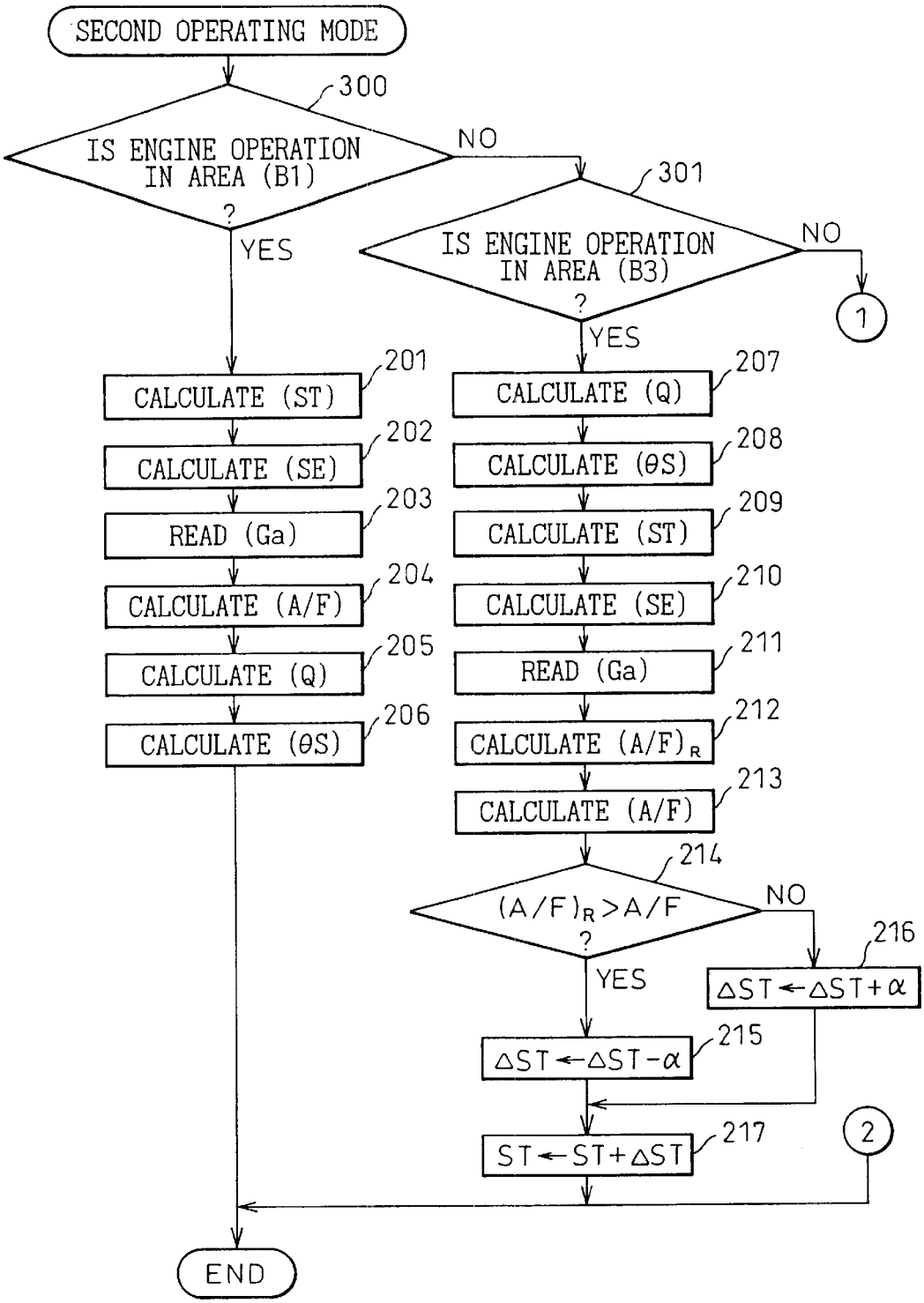
FIG. 21 is a part of a flowchart showing a subroutine carried out at step 102 of FIG. 7.
Figure 22:
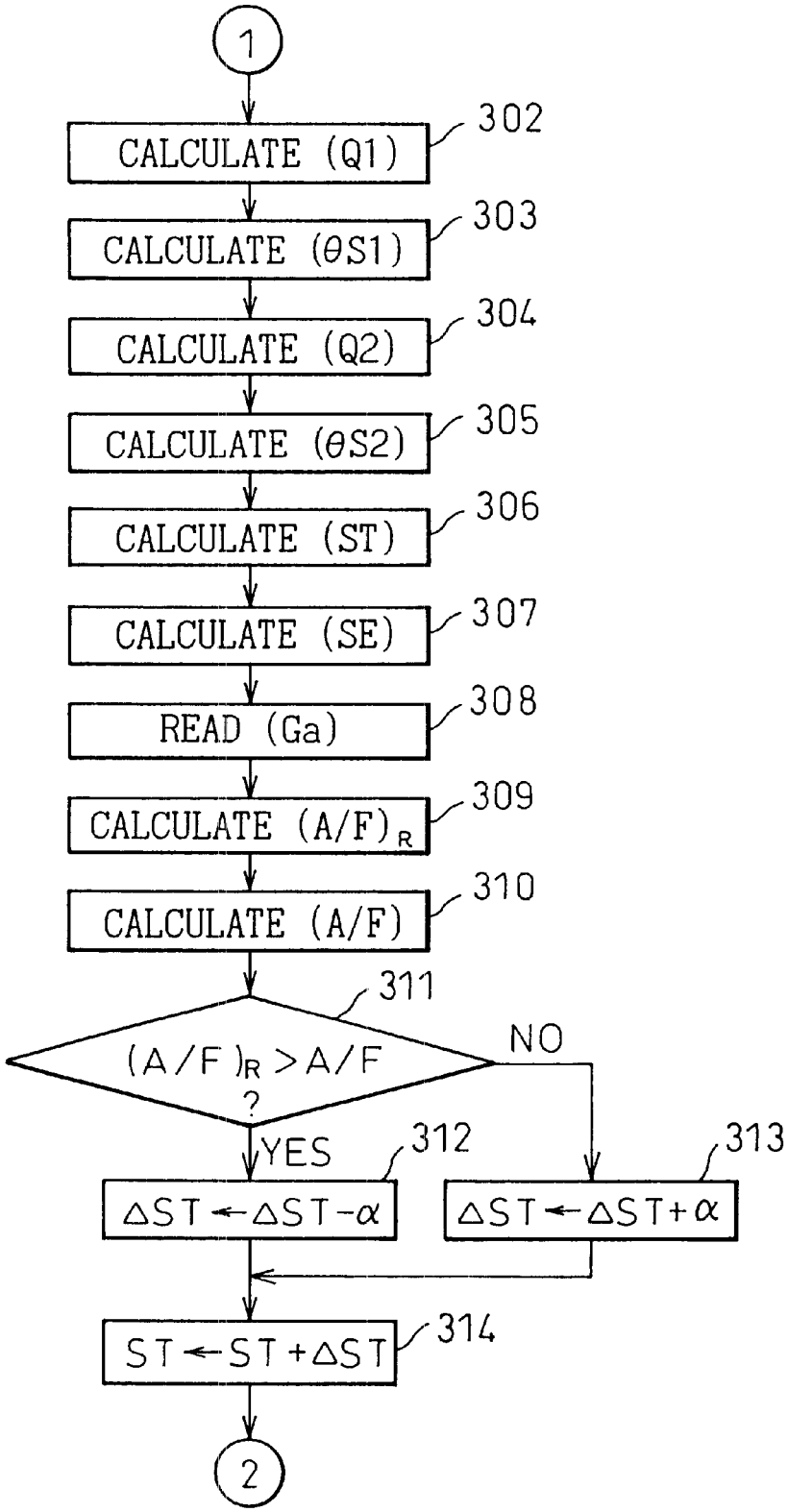
FIG. 22 is the remainder of the flowchart of FIG. 21.

FIGS. 21 and 22 are a flowchart showing a subroutine carried out at step 102 of FIG. 7. As shown in FIGS. 21 and 22, first, at step 300, it is determined if a current engine operation is in the low engine load operating area (B1) of FIG. 6(B). When the result is "YES", the routine goes to step 201. When the result is "NO", the routine goes to step 301. At step 201, a target opening degree (ST) of the throttle valve 17 is calculated from the map shown in FIG. 10(A) similarly to the case that the first operating mode is selected (FIG. 8), and an opening degree of the throttle valve 17 is made the target opening degree (ST). Next, at step 202, a target opening degree (SE) of the EGR control valve 25 is calculated from the map shown in FIG. 10(B) similarly to the case that the first operating mode is selected (FIG. 8), and an opening degree of the EGR control valve 25 is made the target opening degree (SE). Next, at step 203, an amount of intake air (Ga) detected by the air-flow meter 44 is read and at step 204, a target air-fuel ratio A/F is calculated from the map shown in FIG. 9(B) similarly to in case that the first operating mode is selected (FIG. 8). Next, at step 205, an amount of injected fuel (Q) required to make an air-fuel ratio the target air-fuel ratio A/F is calculated on the basis of the amount of intake air (Ga) and at step 206, a target starting time of fuel injection (θS) is calculated from the map shown in FIG. 11 similarly to the case that the first operating mode is selected (FIG. 8).

At step 301, it is determined if a current engine operation is in the high engine load operating area (B3) of FIG. 6(B). When the result is "YES", the routine goes to step 207. When the result is "NO", the routine goes to step 302. At step 207, a target amount of injected fuel (Q) is calculated from the map shown in FIG. 12(A) similarly to the case that the first operating mode is selected (FIG. 8) and an amount of injected fuel is made the target amount (Q). Next, at step 208, a target starting time of fuel injection (θS) is calculated from the map shown in FIG. 12(B) similarly to the case that the first operating mode is selected (FIG. 8) and a starting time of fuel injection is made the target starting time (θS). Next, as step 209, a target opening degree (ST) of the throttle valve 17 is calculated from the map shown in FIG. 14(A) similarly to the case that the first operating mode is selected (FIG. 8). Next, at step 210, a target opening degree (SE) of the EGR control valve 25 is calculated from the map shown in FIG. 14(B) similarly to the case that the first operating mode is selected (FIG. 8), and an opening degree of the EGR control valve 25 is made the target opening degree (SE). Next, at step 211, an amount of intake air (Ga) detected by the air-flow meter 44 is read and at step 212, the actual air-fuel ratio $(A/F)_R$ is calculated on the basis of the amount of injected fuel (Q) and the amount of intake air (Ga) similarly to the case that the first operating mode is selected (FIG. 8).

Figure 13B:
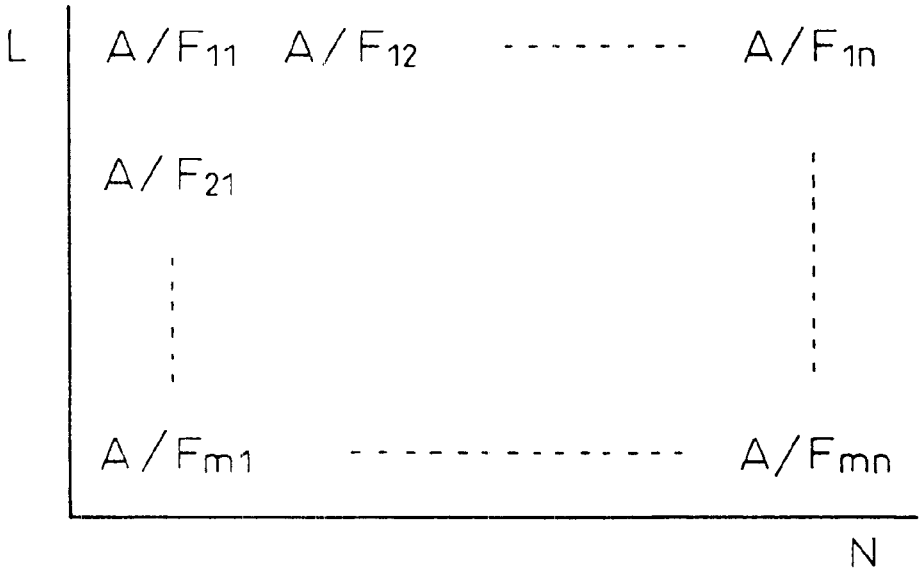
Figure 14A:
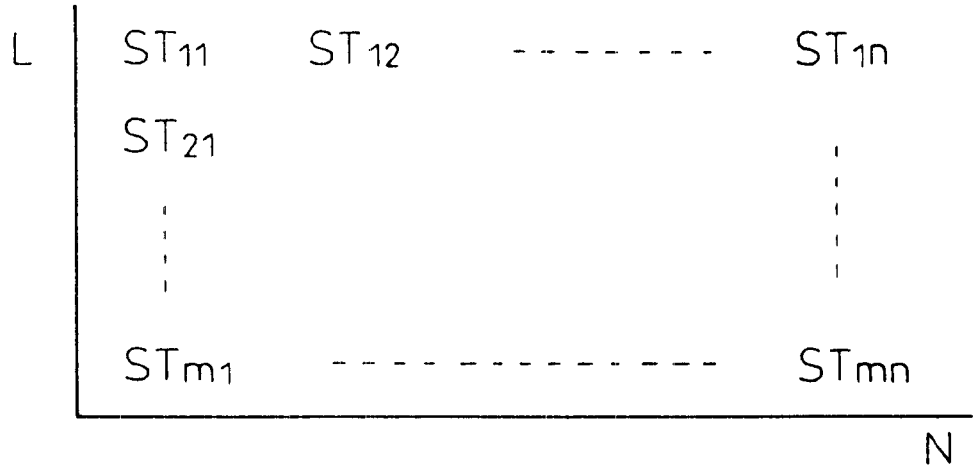
FIG. 14(A) is a map of target opening degrees of the throttle valve in the middle and high engine load operating area (A2)
Figure 14B:
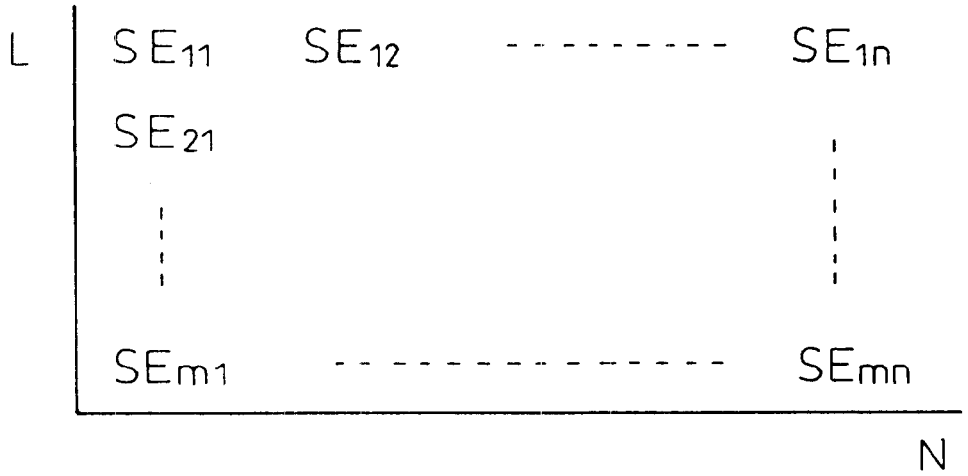
FIG. 14(B) is a map of target opening degrees of the EGR control valve in the middle and high engine load operating area (A2)

Next, at step 213, a target air-fuel ratio A/F is calculated from the map shown in FIG. 13(B) similarly to the case that the first operating mode is selected (FIG. 8). Next, at step 214, it is determined if the actual air-fuel ratio $(A/F)_R$ is larger than the target air-fuel ratio A/F. When $(A/F)_R$ is larger than A/F, the routine goes to step 215 and a correction value (ΔST) of the opening degree of the throttle valve is decreased by a constant (α) similarly to the case that the first operating mode is selected (FIG. 8) and the routine goes to step 217. On the other hand, when $(A/F)_R$ is equal to or smaller than A/F, the routine goes to step 216 and the correction value (ΔST) is increased by the constant (α) and the routine goes to step 217. At step 217, a final opening degree (ST) of the throttle valve 17 is calculated such that the correction value (ΔST) is added to the target opening degree (ST) and an opening degree of the throttle valve 17 is made the final opening degree (ST). That is, an opening degree of the throttle valve 17 is controlled such that the actual air-fuel ratio $(A/F)_R$ is made the target air-fuel ratio A/F.

Figure 23A:
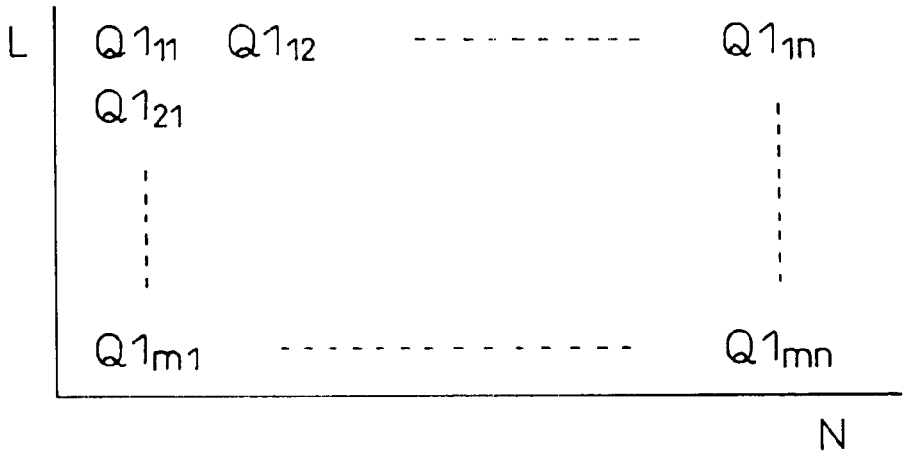
FIG. 23(A) is a map of target amounts of fuel of the main fuel injection in a middle engine load operating area (B2)

On the other hand, at step 301, when it is determined that a current operation is in the middle engine load operating area (B2) of FIG. 6(B), the routine goes to step 302 and a target amount (Q1) of fuel for the main fuel injection is calculated from a map shown in FIG. 23(A) and an amount of fuel for the main fuel injection is made the target amount (Q1). Next, at step 303, a target starting time of the main fuel injection (θS1) is calculated from a map shown in FIG. 23(B) and a starting time of the main fuel injection is made the target starting time (θS1). In the present embodiment, the target starting time (θS1) of the main fuel injection is later than the target starting time (θS) of the fuel injection at step 208 of FIG. 21. Next, at step 304, an amount of fuel (Q2) for the sub fuel injection is calculated from a map FIG. 24(A) and an amount of fuel for the sub fuel injection is made the target amount (Q2). Next, at step 305, a target starting time (θS2) of the sub fuel injection is calculated from a map shown in FIG. 24(B) and a starting time of the sub fuel injection is made the target starting time (θS2). In the present embodiment, the target starting time (θS2) of the sub fuel injection is set in the exhaust stroke or the expansion stroke. However, the target starting time (θS2) may be set in the compression stroke. In this case, the sub fuel injection is carried out immediately before the main fuel injection.

Figure 25A:
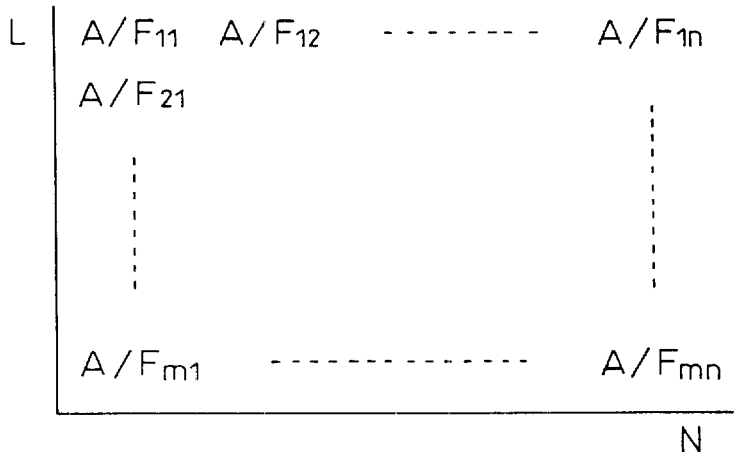
FIG. 25(A) is a map of air-fuel ratios in the middle engine load operating area (B2)
Figure 25B:
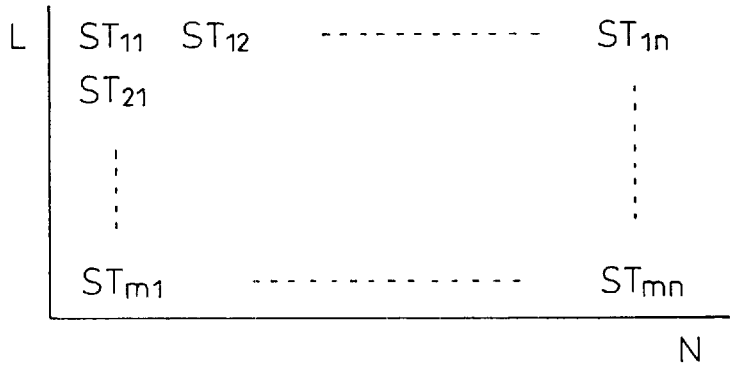
FIG. 25(B) is a map of target opening degrees of the throttle valve in the middle engine load operating area (B2)
Figure 25C:
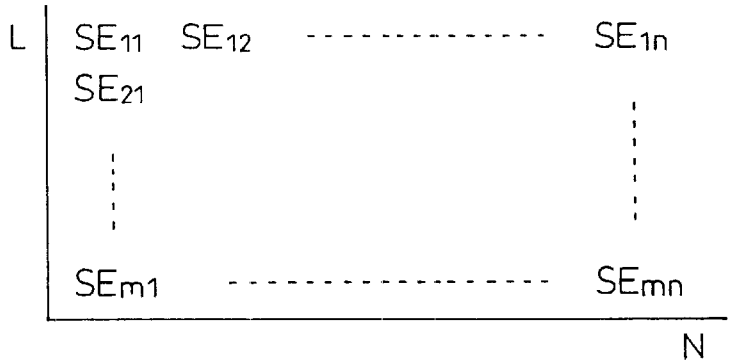
FIG. 25(C) is a map of target opening degrees of the EGR control valve in the middle engine load operating area (B2)

Next, at step 306, a target opening degree (ST) of the throttle valve 17 is calculated from a map shown in FIG. 25(B). At step 307, a target opening degree (SE) of the EGR control valve 25 is calculated from a map shown in FIG. 25(C) and an opening degree of the EGR control valve is made the target opening degree (SE). Next, at step 308, an amount of intake air (Ga) detected by the air-flow meter 44 is read. At step 309, the actual air-fuel ratio $(A/F)_R$ is calculated on the basis of the amount of injected fuel (Q) and the amount of intake air (Ga). Next, at step 310, a target air-fuel ratio A/F is calculated from a map shown in FIG. 25(A) and at step 311, it is determined if the actual air-fuel ratio $(A/F)_R$ is larger than the target air-fuel ratio A/F. When $(A/F)_R$ is larger than A/F, the routine goes to step 312 and a correction value of the opening degree of the throttle valve (ΔST) is decreased by a constant (α) and the routine goes to step 314. On the other hand, when $(A/F)_R$ is equal to or smaller than A/F, the routine goes to step 313 and the correction value (ΔST) is increased by the constant (α) and the routine goes to step 314. At step 314, a final opening degree (ST) of the throttle valve 17 is calculated such that the correction value (ΔST) is added to the target opening degree (ST) and an opening degree of the throttle valve 17 is made the final opening degree (ST). That is, an opening degree of the throttle valve 17 is controlled such that the actual air-fuel ratio $(A/F)_R$ is made the target air-fuel ratio A/F.

The target air-fuel ratio A/F in the middle engine load operating area when the second operating mode is selected, is memorized in ROM 32 as the map shown in FIG. 25(A) in which it is a function of the required engine load (L) and the engine speed (N). The target opening degree (ST) of the throttle valve 17 required to make the air-fuel ratio the target air-fuel ratio A/F shown in FIG. 25(A) is memorized in ROM 32 as the map shown in FIG. 25(B) in which it is a function of the required engine load (L) and the engine speed (N). The target opening degree (SE) of the EGR control valve 25 required to make the air-fuel ratio the target air-fuel ratio A/F shown in FIG. 25(A) is memorized in ROM 32 as the map shown in FIG. 25(C) in which it is a function of the required engine load (L) and the engine speed (N). Besides, the amount of fuel for the main fuel injection (Q1) in the middle engine load operating area when the second operating mode is selected, is calculated on the basis of the required engine load (L) and the engine speed (N). The amount of fuel (Q1) for the main fuel injection is memorized in ROM 32 the map shown in FIG. 23(A) in which it is a function of the required engine load (L) and the engine speed (N). Similarly, the starting time of the main fuel injection (θS1) in the middle engine load operating area when the second operating mode is selected, is calculated on the basis of the required engine load (L) and the engine speed (N). The starting time of the main fuel injection (θS1) is memorized in ROM as the map shown in FIG. 23(B) in which it is a function of the required engine load (L) and the engine speed (N). Further, the amount of fuel for the sub fuel injection (Q2) in the middle engine load operating area when the second operating mode is selected, is calculated on the basis of the required engine load (L) and the engine speed (N). The amount of fuel (Q2) for the sub fuel injection is memorized in ROM 32 the map shown in FIG. 24(A) in which it is a function of the required engine load (L) and the engine speed (N). Similarly, the starting time of the sub fuel injection (θS2) in the middle engine load operating area when the second operating mode is selected, is calculated on the basis of the required engine load (L) and the engine speed (N). The starting time of the sub fuel injection (θS2) is memorized in ROM 32 as the map shown in FIG. 24(B) in which it is a function of the required engine load (L) and the engine speed (N).

Figure 26:
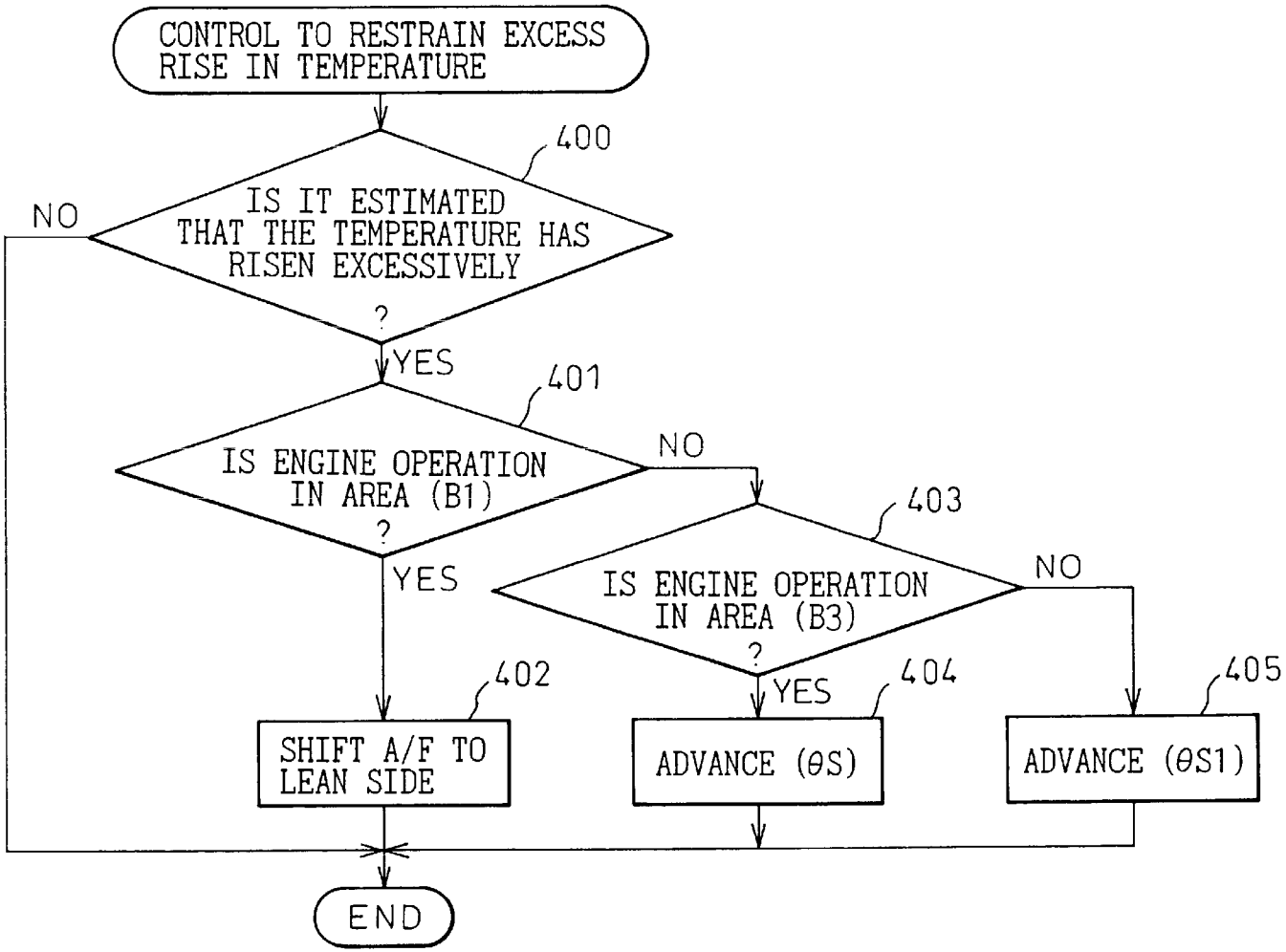
FIG. 26 is a flowchart showing a control method to restrain excess rising of the temperature of the particulate filter in the second operating mode.

FIG. 26 is a flowchart showing a control method to restrain an excess increase of the temperature of the particulate filter 22*a*. The routine is carried out to interrupt the routine of FIG. 7 when the result at step 100 of FIG. 7 is "YES" and the particulate filter 22*a* is regenerated. As shown in FIG. 26, first at step 400, it is estimated if the temperature of the particulate filter 22*a* rises excessively. In the present embodiment, when the result at step 100 of FIG. 7 is "YES" and a predetermined period has elapsed from the time at which the second operating mode is changed over from the first operating mode, it is estimated that the temperature of the particulate filter 22*a* has risen excessively. In another embodiment, when the temperature of the exhaust gas flowing out from the particulate filter 22*a* detected by the flowing-out gas temperature sensor 39*b* is higher than a predetermined threshold, it is estimated that the temperature of the particulate filter 22*a* has risen excessively. When the result at step 400 is "YES", the routine goes to step 401. When the result at step 400 is "NO", the routine is stopped.

Figure 23B:
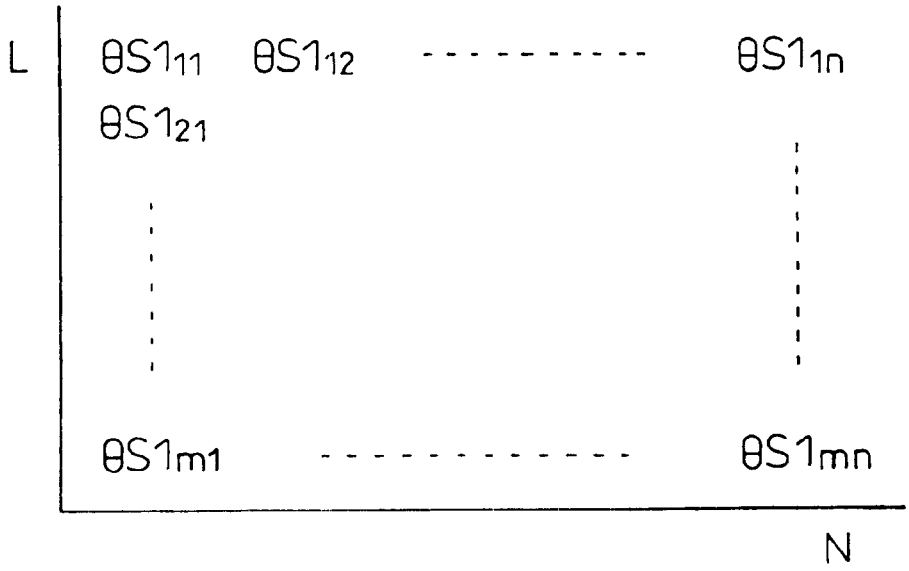
FIG. 23(B) is a map of target starting times of the main fuel injection in the middle engine load operating area (B2)
Figure 24A:
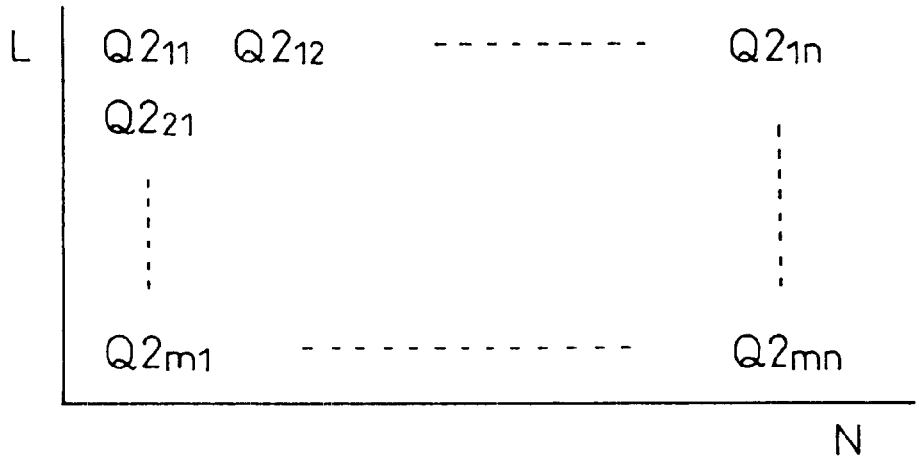
FIG. 24(A) is a map of target amounts of fuel of the sub fuel injection in the middle engine load operating area (B2)
Figure 24B:
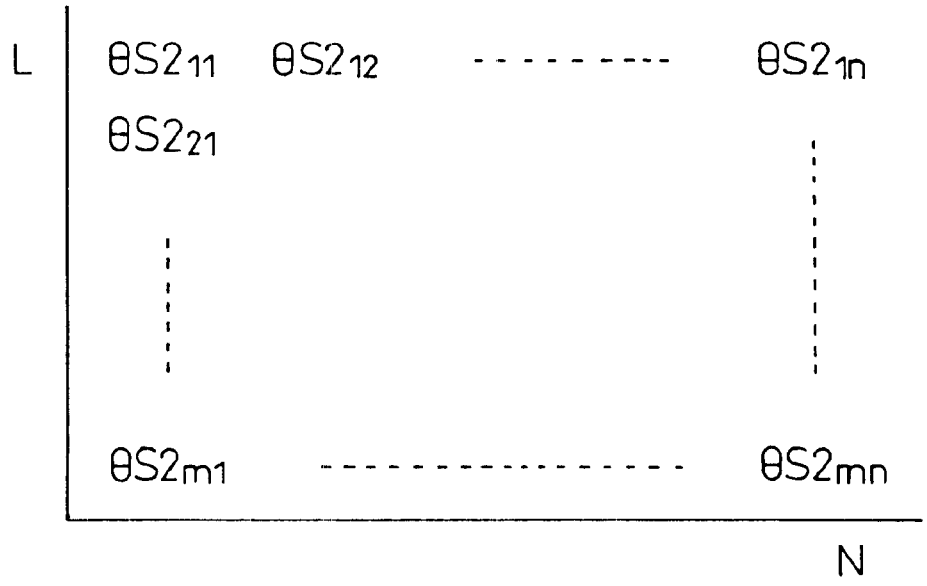
FIG. 24(B) is a map of target starting times of the sub fuel injection in the middle engine load operating area (B2)

At step 401, it is determined if a current engine operation is in the low engine load operating area (B1) of FIG. 6(B). When the result is "YES", i.e., when the low temperature combustion in the low engine load operation is carried out in the selected second operating mode, the routine goes to step 402. When the result is "NO", the routine goes to step 403. At step 402, the target air-fuel ratio A/F calculated at step 204 of FIG. 21 on the basis of the map shown in FIG. 9(B) is shifted to the lean side. As the result, the fuel burns only in the combustion chamber 5 and no fuel burns in the exhaust system. Thus, the temperature of the exhaust gas does not rise excessively. At step 403, it is determined if a current engine operation is in the high engine load operating area (B3) of FIG. 6(B). When the result is "YES", i.e., when the normal combustion in the high engine load operation is carried out in the selected second operating mode, the routine goes to step 404. When the result is "NO", i.e., when the sub fuel injection is carried out and the starting time of the main fuel injection is delayed in the middle engine load operation in the selected second operating mode, the routine goes to step 405. At step 404, the target starting time of fuel injection (θS) calculated at step 208 of FIG. 21 on the basis of the map shown in FIG. 12(B) is advanced. As the result, the fuel burns only in the combustion chamber and no fuel burns in the exhaust system. Thus, the temperature of the exhaust gas does not rise excessively. On the other hand, at step 405, the starting time of the main fuel injection (0S1) calculated at step 303 of FIG. 22 on the basis of the map shown in FIG. 23(B) is advanced and the sub fuel injection is stopped. As the result, the fuel burns only in the combustion chamber 5 and no fuel burns in the exhaust system. Thus, the temperature of the exhaust gas does not rise excessively.

Preferably, at step 402, the target air-fuel ratio A/F is shifted gradually to the lean side, and at step 404, the target starting time of the fuel injection (θS) is gradually advanced, and at step 405, the target starting time of the main fuel injection (θS1) is gradually advanced. In another embodiment, without the processes at steps 402, 404, and 405, when it is estimated that the temperature of the particulate filter 22*a* has risen excessively, the combustion of the first operating mode can be carried out to interrupt the combustion of the second operating mode. Preferably, the frequency of the interruption is gradually increased.

Figure 27A:
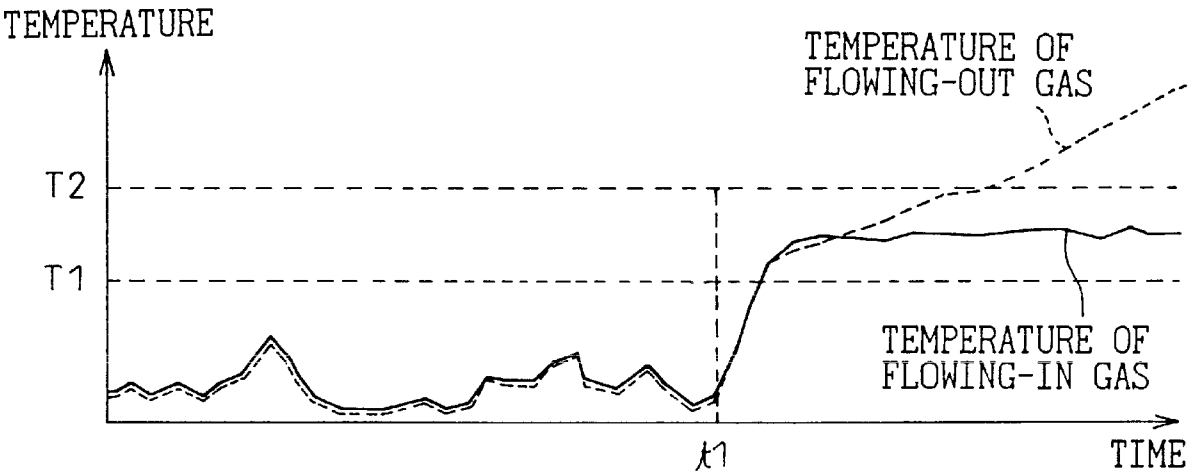
FIGS. 27(A) and 27(B) are time charts of the temperature of the particulate filter.

FIGS. 27 and 28 shown time charts of the varying of the temperature of the particulate filter 22*a*. FIG. 27(A) shows a case where the routine to restrain the excess rise in the temperature of the particulate filter of FIG. 26 is not provided. In the case shown in FIG. 27(A), when it is at the time (t1), the result at step 100 of FIG. 7 becomes "YES" and the combustion in the second operating mode is carried out. Therefore, the HC discharged from the combustion chamber burns in the exhaust system, and the temperature of the exhaust gas flowing in the particulate filter 22*a*, and the temperature of the exhaust gas flowing out therefrom, rise and thus the temperature of the particulate filter 22*a* moves into the regeneration range (T1–T2). However, when the temperature of the flowing-out gas successively rises, since the routine to restrain the excess rising of the temperature of the particulate filter 22*a* is not provided, the temperature of the particulate filter moves into the melting range (not shown).

Figure 27B:
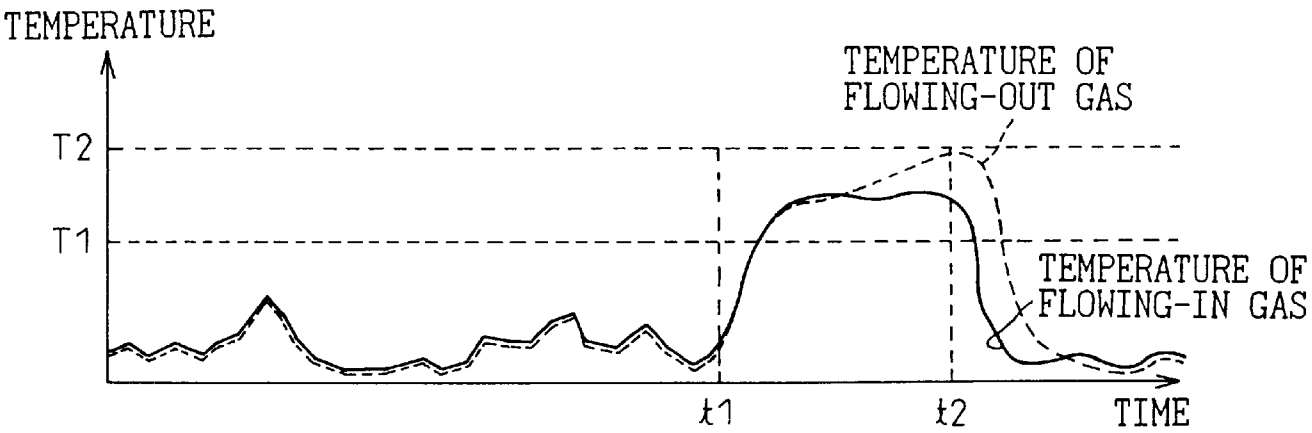
Figure 28A:
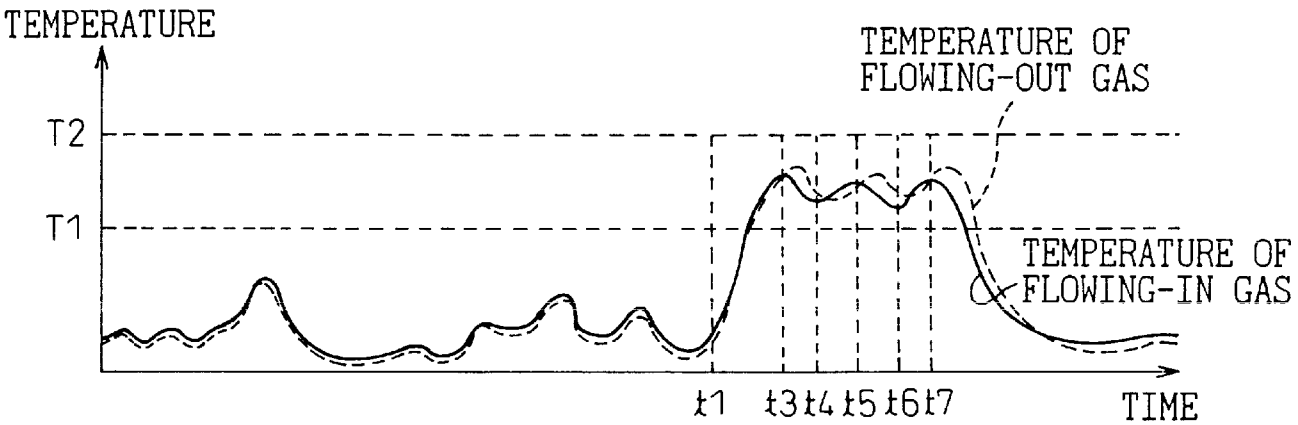
FIGS. 28(A) and 28(B) are time charts of the temperature of the particulate filter.
Figure 28B:
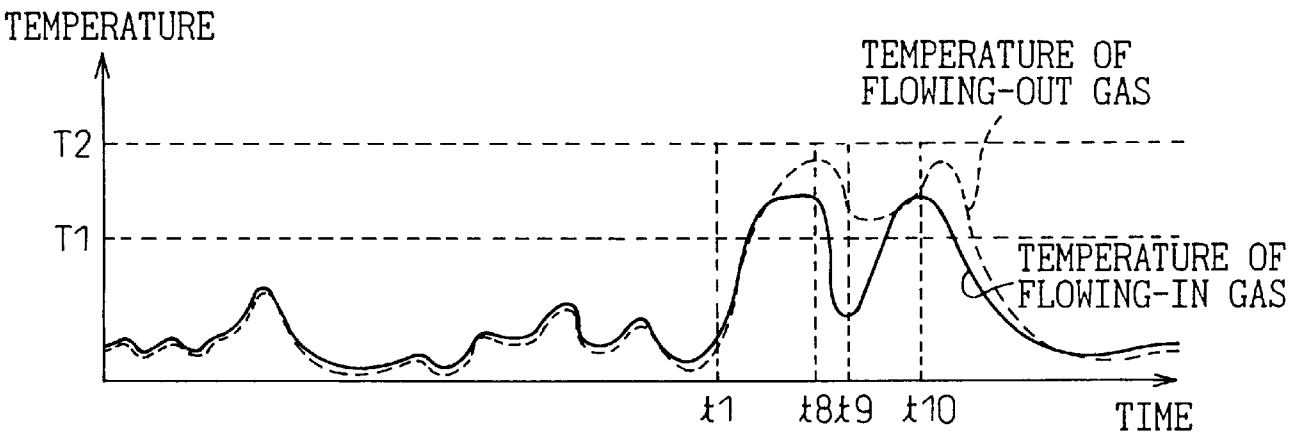

FIGS. 27(B), 28(A), and 28(B) show cases where the routine to restrain the excess rising of the temperature of the particulate filter of FIG. 26 is provided. In the case shown in FIG. 27(A), when it is at the time (t1), the result at step 100 of FIG. 7 becomes "YES" and the combustion in the second operating mode is carried out. Therefore, the HC discharged from the combustion chamber burns in the exhaust system, and the temperature of the exhaust gas flowing in the particulate filter 22*a*, and the temperature of the exhaust gas flowing out therefrom, rise and thus the temperature of the particulate filter 22*a* moves into the regeneration range (T1–T2). Thereafter, when the temperature of the following-out gas does not successively rise, it is not estimated at step 400 of FIG. 26 that the temperature of the particulate filter 22*a* rises excessively. At time (t2), it is determined that it is not the time at which the particulate filter should be regenerated, i.e., that the regeneration of the particulate filter is finished and thus at step 101, the combustion in the first operating mode is carried out.

In the case shown in FIG. 28(A), when it is at the time (t1), the result at step 100 of FIG. 7 becomes "YES" and the combustion in the second operating mode is carried out. Therefore, the HC discharged from the combustion chamber burns in the exhaust system, and the temperature of the exhaust gas flowing in the particulate filter 22*a*, and the temperature of the exhaust gas flowing out therefrom, rise and thus the temperature of the particulate filter 22*a* moves into the regeneration range (T1–T2). Thereafter, when the temperature of the flowing-out gas successively rises, it is estimated at the time (t3) by step 400 of FIG. 26 that the temperature of the particulate filter 22*a* has risen excessively. Accordingly, the process of step 402, 404, or 405 of FIG. 26 is carried out and thus the excess rising of the temperature of the particulate filter 22*a* is restrained. Next, when it is the time (t4), the result at step 400 of FIG. 26 becomes "NO" and the combustion in the second operating mode is carried out again. Next, when it is at the time (t5), it is estimated at step 400 of FIG. 26, again, that the temperature of the particulate filter 22*a* has risen excessively. Accordingly, the process of step 402, 404, or 405 of FIG. 26 is carried out again and thus the excess rising of the temperature. Next, when it is the time (t6), the result at step 400 of FIG. 26 becomes "NO" and the combustion in the second operating mode is carried out again. Next, when it is the time (t7), it is determined that it is not the time at which the particulate filter should be regenerated, i.e., that the regeneration of the particulate filter is finished and thus at step 101, the combustion in the first operating mode is carried out.

In the case shown in FIG. 28(B), when it is the time (t1), the result at step 100 of FIG. 7 becomes "YES" and the combustion in the second operating mode is carried out. Therefore, fuel burns in the exhaust system, and the temperature of the exhaust gas flowing in the particulate filter 22*a,* and the temperature of the exhaust gas flowing out therefrom, rise and thus the temperature of the particulate filter 22*a* moves into the regeneration range (T1–T2). Thereafter, when the temperature of the flowing-out gas successively rises, it is estimated at the time (t8) by step 400 of FIG. 26 that the temperature of the particulate filter 22*a* has risen excessively. Accordingly, the combustion in the first operating mode is carried out to interrupt the combustion in the second operating mode. Next, at the time (t9), the result at step 400 of FIG. 26 becomes "NO" and the combustion in the second operating mode is carried out again. Next, at the time (t10), it is determined that it is not the time at which the particular filter should be regenerated, i.e., the regeneration of the particulate filter is finished and thus at step 101, the combustion in the first operating mode is carried out.

According to the present embodiment, the oxygen absorbing and active-oxygen releasing agent 61 carried in the particulate filter 22*a* takes in and holds oxygen when excessive oxygen is present in the surroundings and releases the held oxygen as active-oxygen when the oxygen concentration in the surroundings falls. Therefore, the particulates on the particulate filter can be oxidized and removed by the active-oxygen without producing luminous flame. Further, according to the present embodiment, the first operating mode (FIG. 6(A)), in which it is given priority to improve the fuel consumption rate of the engine, and the second operating mode (FIG. 6(B)), in which it is given priority to regenerate the particulate filter 22*a,* are changed over at need. Therefore, the fuel consumption rate of the engine can be improved and the deposition of the particulates can be restrained. In detail, at step 100 of FIG. 7, the first operating mode (FIG. 6(A)) is generally selected and the second operating mode (FIG. 6(B)) is selected only when the particulate filter 22*a* must be regenerated. Therefore, the deposition of the particulates is not restrained excessively and thus the fuel consumption rate of the engine does not deteriorate.

Further, according to the present embodiment, when the second operating mode is selected in the middle engine load operating area (B2) of FIG. 6, the sub fuel injection is carried out at step 304 of FIG. 22 and the starting time of the main fuel injection is delayed at step 303. Therefore, in the middle engine load operating area (B2) in which the low temperature combustion cannot be carried out and the high temperature exhaust gas generally cannot be discharged, the temperature of the exhaust gas can be made high and thus the particulate filter can be regenerated.

Further, according to the present embodiment, even when the low temperature combustion is carried out in the selected second operating mode (FIG. 6(B)), if it is estimated that the temperature of the particulate filter 22*a* has risen excessively, the air-fuel ratio is shifted to the lean side at step 402 of FIG. 26. Therefore, the temperature of the exhaust gas flowing into the particulate filter 22*a* made low and thus an excess rise in the temperature of the particulate filter can be prevented. Besides, even when the sub fuel injection is carried out at step 304 of FIG. 22 and the starting time of the main fuel injection is delayed at step 303 of FIG. 22 in the selected second operating mode (B2) of FIG. 6(B), if it is estimated that the temperature of the particulate filter rises excessively, the starting time of the main fuel injection is advanced at step 405 of FIG. 26 and the sub fuel injection is stopped. Therefore, the temperature of the exhaust gas flowing into the particulate filter 22*a* is made low and thus the excess rising of the temperature of the particulate filter can be prevented. Besides, even when the normal combustion is carried out in the selected second operating mode (FIG. 6(B)), if it is estimated that the temperature of the particulate filter 22*a* has risen excessively, the starting time of the fuel injection is advanced at step 404 of FIG. 26. Therefore, the temperature of the exhaust gas flowing into the particulate filter 22*a* is made low and thus the excess rising of the temperature of the particulate filter can be prevented. That is, the temperature of the particulate filter does not rise excessively when the particulate filter is regenerated and thus the particulate filter does not melt.

Further, according to the other embodiment as mentioned above, even when the second operating mode (FIG. 6(B)) is selected, if it is estimated that the temperature of the particulate filter 22*a* has risen excessively, the combustion in the first operating mode (FIG, 6(A)), in which the temperature of the exhaust gas becomes relatively low, is carried out to interrupt the combustion in the second operating mode. Therefore, the temperature of the particulate filter does not rise excessively when the particulate filter is regenerated and thus the particulate filter does not melt.

Further, according to the present embodiment, when the predetermined period has elapsed from the time at which the second operating mode is changed over from the first operating mode, it is estimated that the temperature of the particulate filter has risen excessively. Therefore, it can be easily estimated if the temperature of the particulate filter has risen excessively without the actual detection of the temperature of the particulate filter 22*a*.

Further, according to another embodiment as mentioned above, it is estimated, on the basis of the temperature of the extent gas detected by the flowing-out gas temperature sensor 39*b,* if the temperature of the particulate filter rises excessively. Therefore, it can be precisely estimated if the temperature of the particularly filter has risen excessively without actual detection of the temperature of the particular filter 22*a*.

Further, according to the present embodiment, the catalytic apparatus 22*b* for absorbing and reducing $NO_x$ is arranged in the exhaust gas on the upstream side of the particulate filter 22*a*. Therefore, the reducing materials in the exhaust gas are oxidized when the exhaust gas passes through the catalytic apparatus 22*b* and thus the temperature of the exhaust gas can rise, due to the oxidization heat thereof, to maintain the temperature of the particulate filter relatively high. SOF that functions as a binder of the particulates is also oxidized in the catalytic apparatus 22*b* and thus the particulates cannot be easily deposited.

Further, according to the present embodiment, when it is estimated that the predetermined amount of particulates is deposited on the particulate filter 22*a,* the result at step 100 of FIG. 7 becomes "YES" and the second operating mode (FIG. 6(B)), in which it is given priority to regenerate the particulate filter, is changed over from the first operating mode (FIG. 6(B)) in which it is given priority to improve the fuel consumption rate of the engine. Therefore, the process at step 102 is not successively carried out and the deposition of the particulates is not excessively restrained. Accordingly, the fuel consumption rate of the engine does not deteriorate.

Further, according to the present embodiment, in the low engine load operating area, the low temperature combustion is carried out. Therefore, a relative large amount of reducing materials included in the exhaust gas thereof can burn on the catalytic apparatus 22*b* or on the particulate filter 22*a* and thus the temperature of the exhaust gas flowing into the particulate filter can be raised higher than in the normal combustion. Accordingly, the engine operating region in which the particulate filter can be regenerated can be expanded. Besides, the catalytic apparatus 22*b* having a relative large capacity is arranged in the exhaust gas on the upstream side of the particulate filter 22*a* and thus the temperature of all of the exhaust gas flowing into the particulate filter 22*a* can be made uniform. Therefore, a local excessive rise in the temperature of the particulate filter can be prevented.

Further, according to the present invention, the period in which the first operating mode (FIG. 6(A)) is selected, and the period in which the second operating mode (FIG. 6(B)) is selected, are suitably set. Therefore, a large amount of particulates does not deposit on the particulate filter in the suitable period in which the first operating mode is selected. This can prevent the temperature of the particulate filter rising excessively due to the large amount of oxidization heat of the large amount of particulates when the second operating mode is selected. Besides, the temperature of the particulate filter does not drop excessively in the suitable period in which the first operating mode is selected and the temperature of the particulate filter does not rise excessively in the suitable period in which the second operating mode is selected.

Further, according to the present embodiment, even when the first operating mode is selected, the low temperature combustion is carried out in the low engine load operating area. Therefore, the temperature of the particulate filter 22*a* does not drop and thus, when the second operating mode is changed over immediately after the low temperature combustion is carried out in the selected first operating mode, the period in which the second operating mode is selected can be shortened.

Even when only a nobel metal such as platinum Pt is carried out the particulate filter, active-oxygen can be released from $NO_2$, or $SO_3$ held on the surface of platinum Pt. However, in this case, a curve that represents the amount of particulate that can be oxidized and removed (G) is slightly shifted toward the right compared with the solid curve shown in FIG. 5. Further, ceria can be used as the oxygen absorbing and active-oxygen releasing agent. Ceria absorbs oxygen when the oxygen concentration is high ($Ce_2O_3+\frac{1}{2}O_2 \rightarrow 2CeO_2$) and releases active-oxygen when the oxygen concentration decreases ($2CeO_2 \rightarrow \frac{1}{2}O_2+Ce_2O_3$). Therefore, in order to oxidize and remove the particulates, the air-fuel ratio of the surrounding atmosphere of the particulate filter must be made rich at regular intervals or at irregular intervals. Instead of the ceria, iron Fe or tin Sn can be used as the oxygen absorbing and active-oxygen releasing agent.

In the present embodiment, the particulate filter itself carries the oxygen absorbing the active-oxygen releasing agent and active-oxygen released from the oxygen absorbing and active-oxygen releasing agent oxidizes and removes the particulate. However, this does not limit the present invention. For example, a particulate oxidization material such as active-oxygen and $NO_2$ that functions the same as active-oxygen may be released from a particulate filter or a material carried thereon, or may flow into a particulate filter from the outside thereof. In case that the particulate oxidization material flows into the particulate filter from the outside thereof, if the temperature of the particulate filter rises, the temperature of the particulates themselves rises and thus the oxidizing and removing thereof can be made easy.

Although the invention has been described with reference to specific embodiments thereof, it should be apparent that numerous modifications can be made thereto, by those skilled in the art, without departing from the basic concept and scope of the invention.

What is claimed is:

1. A device for purifying the exhaust gas of an internal combustion engine comprising a particulate filter arranged in the exhaust system, on which the trapped particulates are oxidized, wherein said engine can be operated in a first operating mode in which it is given priority to improve the fuel consumption rate thereof and a second operating mode in which it is given priority to regenerate said particulate filter to oxidize said trapped particles, and one of said first operating mode and said second operating mode is selected to operate said engine at need, wherein said engine can carry out low temperature combustion, in which an amount of inert gas supplied into the combustion chamber is larger than an amount of inert gas causing the maximum amount of produced soot and thus no soot at all is produced, and normal combustion in which an amount of inert gas supplied into the combustion chamber is small than the amount of inert gas causing the maximum amount of produced soot, said engine carriers out said low temperature combustion in a low engine load operating area when said first operating mode is selected, said engine carries out said normal combustion in middle and high engine load operating areas when said first operating mode is selected, said engine carries out said low temperature combustion in the low engine load operating area when said second operating mode is selected, said engine carries out a sub fuel injection and delays the starting time of main fuel injection in the middle engine load operating area when said second operating mode is selected, and said engine carries out said normal combustion in the high engine load operating area when said second operating mode is selected.

2. A device for purifying the exhaust gas of an internal combustion engine according to claim 1, wherein, if it is estimated that the temperature of said particulate filter has risen excessively when said second operating mode is selected, the air-fuel ratio of said low temperature combustion in said low engine load operating area is shifted to the lean side, said starting time of main fuel injection is advanced in said middle engine load operating area, and the starting time of fuel injection in said normal combustion is advanced in said high engine load operating area.

3. A device for purifying the exhaust gas of an internal combustion engine according to claim 2, wherein it is estimated if the temperature of said particulate filter has risen excessively on the basis of the time elapsed from when said second operating mode was changed over from said first operating mode.

4. A device for purifying the exhaust gas of an internal combustion engine according to claim 2, wherein it is estimated if the temperature of said particulate filter has risen excessively on the basis of the temperature of the exhaust gas.

5. A device for purifying the exhaust gas of an internal combustion engine according to claim 2, wherein when said starting time of main fuel injection is advanced in said middle engine load operating area, said sub fuel injection is stopped.

6. A device for purifying the exhaust gas of an internal combustion engine according to claim 5, wherein, if it is estimated that the temperature of said particulate filter has risen excessively when said second operating mode is selected, the combination in said first operating mode is carried out to interrupt the combustion in said second operating mode.

7. A device for purifying the exhaust gas of an internal combustion engine according to claim 1, wherein when a predetermined amount of particulates deposits on said particulate filter, said second operating mode is changed over from said first operating mode.

8. A device for purifying the exhaust gas of an internal combustion engine according to claim 1, wherein a catalytic apparatus having an oxidation function is arranged upstream of said particulate filter.

* * * * *